US012419488B2

(12) United States Patent
Park et al.

(10) Patent No.: US 12,419,488 B2
(45) Date of Patent: Sep. 23, 2025

(54) DISHWASHER

(71) Applicant: LG Electronics Inc., Seoul (KR)

(72) Inventors: Hyung Man Park, Seoul (KR); Deok Won Kang, Seoul (KR); Jeongkon Kim, Seoul (KR); Min Jae Jeong, Seoul (KR); Jeong In Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 385 days.

(21) Appl. No.: 18/077,428

(22) Filed: Dec. 8, 2022

(65) Prior Publication Data

US 2023/0210343 A1 Jul. 6, 2023

(30) Foreign Application Priority Data

Dec. 31, 2021 (KR) ..... 10-2021-0194349
Sep. 22, 2022 (KR) ..... 10-2022-0119923

(51) Int. Cl.
*A47L 15/48* (2006.01)
*A47L 15/42* (2006.01)

(52) U.S. Cl.
CPC ..... *A47L 15/488* (2013.01); *A47L 15/4257* (2013.01); *A47L 15/486* (2013.01)

(58) Field of Classification Search
CPC ... A47L 15/486; A47L 15/4257; A47L 15/488
See application file for complete search history.

(56) References Cited

U.S. PATENT DOCUMENTS 2,918,068 A * 12/1959 Karig ..... A47L 15/483 34/90
3,064,662 A * 11/1962 Given ..... A47L 15/46 134/108
3,117,582 A * 1/1964 Perl ..... A47L 15/488 134/182
3,908,681 A * 9/1975 Schimke ..... A47L 15/486 34/233

(Continued)

FOREIGN PATENT DOCUMENTS

CA 2199095 A * 9/1997 ..... A47L 15/4257
CA 2597854 A1 * 3/2008 ..... A47L 15/4257

(Continued)

OTHER PUBLICATIONS

Machine Translation of EP 1230891 A1 to Ennen et al., Jan. 2002. (Year: 2002).*

(Continued)

*Primary Examiner* — Benjamin L Osterhout
(74) *Attorney, Agent, or Firm* — Fish & Richardson P.C.

(57) ABSTRACT

A dishwasher includes a tub, a door coupled to a front of the tub, and a drying device disposed at the door and configured to dry an inside of the tub. The drying device includes a bracket that defines a space configured to receive the wet air and the dry air, an impeller coupled to the bracket and configured to cause the wet air and the dry air to be mixed, where the impeller is configured to generate a flow of the mixed air. The drying device further includes a cover coupled to the bracket, and an air guide disposed between (Continued)

the bracket and the cover and configured to guide the flow of the mixed air into the impeller. The impeller is rotatably coupled to the air guide.

20 Claims, 23 Drawing Sheets

(56) References Cited

U.S. PATENT DOCUMENTS

| | | | | |
|---|---|---|---|---|
| 8,757,179 | B2 * | 6/2014 | Wetzel | A47L 15/48 134/102.3 |
| 8,758,525 | B2 * | 6/2014 | Kim | A47L 15/488 134/99.1 |
| 2004/0163689 | A1 * | 8/2004 | Lee | A47L 15/4223 134/186 |
| 2006/0231122 | A1 * | 10/2006 | Stelzer | A47L 15/486 134/25.2 |
| 2007/0006898 | A1 * | 1/2007 | Lee | A47L 15/0034 134/25.2 |
| 2008/0077235 | A1 * | 3/2008 | Kirson | A61F 2/2418 623/2.11 |
| 2008/0087307 | A1 * | 4/2008 | Han | A47L 15/486 134/104.4 |
| 2008/0264455 | A1 * | 10/2008 | Brewer | A47L 15/483 134/95.2 |
| 2015/0320289 | A1 * | 11/2015 | Stutts | A47L 15/488 134/184 |
| 2015/0359412 | A1 * | 12/2015 | Delgado | A47L 15/4463 134/198 |
| 2016/0022115 | A1 * | 1/2016 | Vallejo Noriega | A47L 15/486 34/443 |
| 2016/0022116 | A1 * | 1/2016 | Delellis | A47L 15/486 34/218 |
| 2017/0319045 | A1 * | 11/2017 | Wu | A47L 15/488 |
| 2019/0335974 | A1 * | 11/2019 | Kopera | A47L 15/4251 |
| 2019/0350432 | A1 * | 11/2019 | Kopera | A47L 15/486 |
| 2020/0100644 | A1 * | 4/2020 | Kopera | A47L 15/488 |

FOREIGN PATENT DOCUMENTS

| | | | | |
|---|---|---|---|---|
| CH | 683819 | A5 * | 5/1994 | A47L 15/483 |
| EP | 521815 | A1 * | 1/1993 | A47L 15/4257 |
| EP | 1230891 | A1 * | 8/2002 | A47L 15/486 |
| EP | 1961362 | A2 * | 8/2008 | A47L 15/0013 |
| EP | 1551272 | B1 * | 2/2012 | A47L 15/0034 |
| EP | 3263005 | A1 * | 1/2018 | A47L 15/0026 |
| EP | 3469977 | A1 * | 4/2019 | A47L 15/0028 |
| EP | 3622875 | B1 * | 11/2022 | A47L 15/0044 |
| KR | 20070120254 | | 12/2007 | |
| WO | WO-2004019750 | A1 * | 3/2004 | A47L 15/0034 |
| WO | WO-2016083615 | A1 * | 6/2016 | A47L 15/0036 |
| WO | WO-2017052796 | A1 * | 3/2017 | |

OTHER PUBLICATIONS

Machine Translation of EP 1551272 B1 to Lilja, Aug. 2003. (Year: 2003).*

Machine Translation of EP 0521815 A1 to Huettemann et al., Jun. 1992. (Year: 1992).*

Machine Translation of CH 683819 A5 to Voegl et al., May 1994. (Year: 1994).*

* cited by examiner

DISHWASHER

CROSS-REFERENCE TO RELATED APPLICATIONS

This application claims priority to and benefit of Korean Patent Application Nos. 10-2021-0194349, filed on Dec. 31, 2021, and 10-2022-0119923, filed on Sep. 22, 2022, which are hereby incorporated by reference as if fully set forth herein.

TECHNICAL FIELD

The present disclosure relates to a dishwasher including a drying device.

BACKGROUND

A dishwasher is an electric appliance configured to wash dishes provided as washing targets by, for example, spraying wash water. In some cases, wash water used for dishwashing can include a dishwashing detergent.

By using the dishwasher, the time and effort for washing dishes that are washing targets after eating may be reduced, thereby contributing to user's convenience.

In some cases, the dishwasher may include a drying device. The drying device may be configured to operate after a heating and rinsing process configured to rinse the dishes stored in the tub by heating wash water in a washing process. For example, the drying device is configured to continuously lower the humidity inside the tub by mixing the humid air flowing in from the inside of the tub and the dry air flowing in from the outside of the tub and discharging the mixed air to the outside of the dishwasher. Accordingly, the drying device may discharge steam from the inside to the outside of the tub and vaporize the wash water remaining on surfaces of the dishes stored in the tub, only to dry the dishes.

An air flow path may be formed inside the drying device. A gap may be generated on the air flow path. If air leaks to the outside through the gap, the operating efficiency of the drying device may be lowered.

In some cases, an impeller may be provided in the drying device. In some cases, air that reaches an entrance of the impeller may cause rapid flow and a circulating air flow may occur at a position adjacent to the inlet of the impeller. Such circulating air flow might lower the operating efficiency of the drying device.

In order to mount various components inside the drying device, a bracket and a cover may define an exterior of the drying device and have a complex three-dimensional structure as a whole. In some cases, the bracket and the cover may be fabricated by injection molding. In the complex 3D-structure, an undercut may be a difficult part to take out the bracket and cover from a mold after injection molding. A structure capable of avoiding such an undercut may facilitate the fabrication of the drying device and reduce the manufacturing cost.

In some cases, when the impeller operates in the drying device, wet air inside the tub may flow inside a motor of the drying device.

SUMMARY

The present disclosure describes a dishwasher including a drying device having a structure that can effectively seal a portion where air flows.

The present disclosure further describes a dishwasher including a drying device that can facilitate smooth air flow inside the drying device and suppress occurrence of circulating flow of air.

The present disclosure further describes a dishwasher including a drying device having a structure configured to suppress occurrence of undercut.

The present disclosure further describes a dishwasher including a drying device having a structure configured to facilitate an easy assembling work.

The present disclosure further describes a dishwasher including a drying device having a structure configured to block wet air flowing inside the drying device from being introduced into a motor for driving an impeller.

According to one aspect of the subject matter described in this application, a dishwasher includes a tub that defines a washing space configured to accommodate objects to be washed, a door coupled to a front of the tub and configured to open and close the tub, and a drying device disposed at the door and configured to dry an inside of the tub, where the drying device is configured to guide (i) wet air discharged from the inside of the tub and (ii) dry air introduced from an outside of the tub. The drying device includes a bracket that defines a space configured to receive the wet air and the dry air, an impeller coupled to the bracket and configured to cause the wet air and the dry air to be mixed, where the impeller is configured to generate a flow of the mixed air, a cover coupled to the bracket, and an air guide disposed between the bracket and the cover and configured to guide the flow of the mixed air into the impeller. The impeller is rotatably coupled to the air guide.

Implementations according to this aspect can include one or more of the following features. For example, the bracket can include a first bushing that is coupled to the cover and protrudes in a direction of a rotational axis of the impeller, where the first bushing defines a space that accommodates at least a portion of the impeller. The air guide can include a second bushing that protrudes in the direction of the rotation axis of the impeller and defines an edge area of the air guide, where the second bushing is disposed inside the first bushing such that the first bushing and the second bushing overlap with each other. In some examples, the bracket can further include a casing that defines a mounting space of the impeller, where the mounting space includes a first through-hole that is open in the direction of the rotation axis of the impeller.

In some examples, the air guide can define a second through-hole at a position corresponding to the first through-hole, where the second through-hole is in fluid communication with the cover. In some examples, the drying device can further include a duct that is in fluid communication with the bracket and an outlet of the cover, where the duct is configured to discharge the mixed air from the impeller to the outside. In some implementations, the air guide can include a body that defines the second through-hole, and an extending portion that extends from the body and is disposed inside the duct.

In some implementations, the duct can include a pair of coupling protrusions that protrude from an inner surface of the duct and face each other, where the pair of coupling protrusions are coupled to the extending portion. The extending portion can define a first inserting hole at a position corresponding to a first coupling protrusion of the pair of coupling protrusions, where the first inserting hole receives the first coupling protrusion. In some examples, the bracket can define a second inserting hole at a position corresponding to a second coupling protrusion of the pair of coupling protrusions, where the second inserting hole receives the second coupling protrusion.

In some implementations, the extending portion can include a sealing protrusion that protrudes toward the bracket and the cover, where the sealing protrusion is in contact with the bracket, the cover, and the duct to thereby block the mixed air from leaking through a gap defined among the bracket, the cover, and the duct. In some examples, the air guide can include a bell mouth that extends along a circumference of the second through-hole and has a convex shape protruding toward the cover, where the bell mouth is configured to guide the flow of the mixed air from the cover to the impeller.

In some examples, the air guide can further include a guide ring that protrudes from the body toward the bracket and surrounds the bell mouth. In some examples, the guide ring can include a first region disposed inside the second bushing, and a second region disposed at a portion of the edge area of the air guide in which the second bushing is not provided, where the second region and the first bushing overlap with each other. In some examples, the guide ring can be configured to reduce a circulation flow of the mixed air along the bell mouth based on the mixed air being introduced into the impeller through the second through-hole.

In some implementations, the bracket can define a first inlet that is in fluid communication with the outside of the tub and configured to receive the dry air from the outside, and a second inlet that is spaced apart from the first inlet and in fluid communication with the tub, where the second inlet is configured to receive the wet air from the tub. In some examples, the drying device can further include a valve coupled to the bracket and disposed in a flow path of the wet air, where the valve is configured to open and close the second inlet.

In some examples, the bracket can include a first communication portion that defines a space in fluid communication with the cover, a partition wall that defines the second inlet and partitions off the first communication portion from an inner space of the bracket, and a first outlet that is in fluid communication with the duct and configured to discharge the mixed air having passed through the impeller. In some examples, the cover can include a second communication portion that is coupled to the first communication portion and defines a space in fluid communication with the bracket, and a third inlet that enables fluid communication between the second communication portion and the tub, where the third inlet is configured to supply the wet air from the tub into the drying device.

In some implementations, the drying device can further include a motor disposed in the casing and configured to rotate the impeller, and the casing can define a slit hole that surrounds at least a portion of the motor and is configured to receive the dry air into the casing. In some examples, the casing can include an outer panel that defines the slit hole, and an inner panel that is spaced apart from the outer panel and defines a flow portion together with the outer panel, where the flow portion is configured to carry the dry air introduced into the casing. The motor is mounted to the outer panel, and the slit hole extends along at least the portion of the motor. In some examples, the motor can include a driving part coupled to the outer panel, and a bent portion that is coupled to the driving part and defines a groove accommodating the driving part, where the slit hole is spaced apart from the bent portion in a radial direction of the driving part.

In some implementations, the flow direction of the mixed air passing through the second through-hole near the bell mouth can be changed to flow in a radial direction of the impeller, and then the mixed air can blocked by the guide ring so that the flow direction of the mixed air can changed again in a direction perpendicular to the radial direction of the impeller to introduce the mixed air into the impeller.

In some implementations, the first bushing of the bracket can overlap with the second bushing and the guide ring of the air guide so that the area, in which air is introduced into the impeller, inside the drying device can be effectively sealed. Accordingly, the flow path of the air inside the drying device can be maintained airtight to enhance operating efficiency of the drying device.

In some implementations, the sealing protrusion having a 3d and relatively completed shape can be formed in the air guide having a relatively simple shape, without forming it in the bracket or cover having a complicated shape. Accordingly, the structure corresponding to the sealing protrusion can be formed in the bracket or cover, thereby suppressing occurrence of undercut. When fabricating the drying device by injection molding, the manufacturing time and price can be reduced.

In some implementations, the bell mouth can be formed in the edge of the second through-hole of the air guide, thereby facilitating the smooth flow of the mixed air introduced into the second through-hole of the air guide and improving the operating efficiency of the drying device.

In some implementations, the guide ring can effectively suppress the circulating flow of the mixed air an area near the bell mouth by guiding the flow direction of the mixed air introduced into the second through-hole. Accordingly, the mixed air can be smoothly introduced into the impeller and the rotation of the impeller may not be hindered by the circulating flow; thereby reducing power consumption of the impeller and improving the operating efficiency of the drying device.

In some implementations, the assembling of the bracket, the air guide and the cover can be completed by performing one fusion or coupling process, thereby facilitating the assembly of the drying device and reducing the manufacturing cost of the drying device and also effectively suppressing assembly detects.

In some implementations, the slit hole can be formed in the casing. When the impeller is rotated, outside dry air can be suppressed from flowing into the flow portion formed in the casing and wet air can be suppressed from flowing into the flow portion, thereby effectively suppressing the wet air flowing into the driving part through the flow portion from corroding the components inside the driving part.

Specific effects are described along with the above-described effects in the section of Detailed Description.

DETAILED DESCRIPTION

Figure 1:
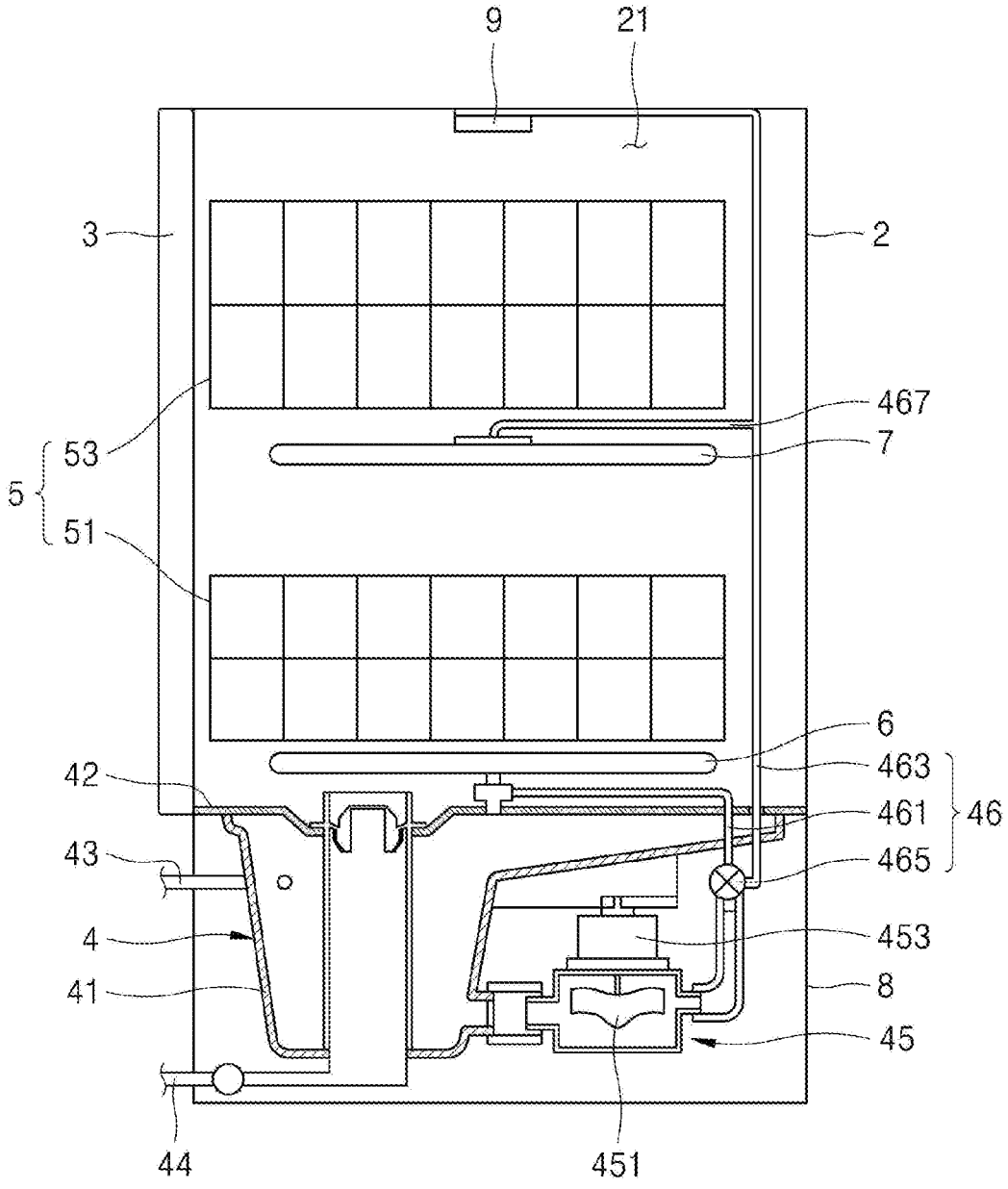
FIG. 1 is a sectional view schematically showing an example of a dishwasher.

The above-described aspects, features and advantages are specifically described hereunder with reference to the accompanying drawings such that one having ordinary skill in the art to which the present disclosure pertains can easily implement the technical spirit of the disclosure. In the drawings, identical reference numerals can denote identical or similar components.

Throughout the present disclosure, "up-down direction (or a vertical direction)" refers to an up-and-down direction of a dishwasher that is installed for daily use. "Left-right direction (or horizontal direction)" refers to a direction orthogonal to the up-down direction, and "front-back direction refers to a direction orthogonal to both the up-down direction and the left-right direction. "Both side directions" or "lateral directions" have the same meaning as the left-right direction. These terms can be used interchangeably herein.

FIG. 1 is a sectional view schematically showing an example of a dishwasher.

In some implementations, referring to FIG. 1, the dishwasher can include a housing defining an exterior of the dishwasher, a tub 2 defining a washing space 21 inside the housing and configured to receive dishes as washing targets, a door 3 rotatably coupled to a base 8 and configured to selectively open and close the washing space 21, a sump 4 provided in a lower area of the tub 2 and configured to store wash water, a storage part 5 provided inside the tub 2 and configured to store the washing targets, and spray arms 6, 7, and 9) configured to spray wash water toward the washing targets stored in the storage part 5. For instance, dishes can include bowls, plates, spoons, chopsticks, or other cooking utensils.

The tub 2 can define the washing space 21 and receive dishes. The storage part 5 and the spray arms 6, 7, and 9) can be provided inside the washing space 21. The tub has one open surface and the open surface can be closable by the door 3.

The door 3 can be rotatably coupled to the housing and configured to selectively open and close the washing space. For example, a lower portion of the door 3 can be coupled to the housing by a hinge. For example, the door 3 can be rotatably on the hinge to open and close the tub 2. When the door 3 is opened, the storage part 5 can be drawn to the outside of the dishwasher and the drawn storage part 5 can be supported by the door 3.

The sump 4 can include a storage portion 41 configured to store wash water, a sump cover 42 configured to partition off the storage portion 41 from the tub 2, a water supply portion 43 configured to supply wash water to the storage portion 41 from the outside, a water discharge portion 44 configured to discharge the wash water from the storage portion 41, and a water supply pump 45 and a water supply path 46 that are configured to supply the wash water stored in the storage portion 41 to the spray arms 6, 7, and 9.

The sump cover 42 can be disposed on a top of the sump 4 and configured to separate the sump 4 from the tub 2. In addition, the sump cover 42 can include a plurality of water collection holes configured to recollect the wash water sprayed to the washing space 21 through the spray arms 6, 7, and 9.

Specifically, the wash water sprayed from the spray arms 6, 7, and 9 can fall down to the bottom of the washing space 21 and pass through the sump cover 42 to be recollected in the storage portion 41 of the sump 4.

The water supply pump 45 can be provided in a side area or a lower area of the storage portion 41 and configured to supply wash water to the spray arms 6, 7, and 9.

The water supply pump 45 can have one end connected to the storage portion 41 and the other end connected to the water supply path 46. An impeller 451 and a motor 453 can be provided inside the water supply pump 45. When electricity is supplied to the motor 453, the impeller 451 can be rotated and the wash water of the storage portion 41 can be supplied to the spray arms 6, 7, and 9 through the water supply path 46.

The water supply path 46 can be configured to selectively supply the wash water flowing in from the water supply pump 45 to the spray arms 6, 7, and 9.

The water supply path 46 can include a first water supply path 461 connected to a lower spray arm 6, a second water supply path 463 connected to an upper spray arm 7 and a top nozzle 9, and a water supply path switching valve 465 configured to selectively open and close the water supply paths 461 and 467. In this instance, the water supply path switching valve 465 can be controlled to sequentially or simultaneously open the water supply paths 461 and 463.

At least one storage part 5 can be provided in the washing space 21 to store dishes. In some examples, two storage parts 5 can be provided in the dishwasher, as shown in FIG. 1, but the present disclosure is not limited thereto.

As one example, the dishwasher can include only one storage part or three or more storage parts. In this instance, the number of the spray arms can be variable based on the number of the storage parts.

The storage part 5 can include a lower rack 51 and an upper rack 53 to store dishes. The lower rack 51 can be disposed in the washing space 21 and dishes can be stored in the lower rack 51. The upper rack 53 can be disposed above the lower rack 51 and dishes can be stored in the upper rack 53. In some examples, a top rack can be disposed between a space between a top of the upper rack 53 and a top nozzle 9, and dishes can be stored in the top rack.

The lower rack 51 can be disposed above the sump 4 and the upper rack 53 can be positioned higher than the lower rack 51. The lower rack 51, the upper rack 53, and the top rack can be movable to the outside through the open surface of the tub 2.

In some implementations, a rail type holder can be provided on an inner surface of the tub 2. Wheels can be provided on a lower surface of the rack 51 and 53. The user can store dishes or take out the washed dishes by withdrawing the storage part 5 to the outside.

The spray arm can be provided inside the tub 2 and configured to spray wash water toward the dishes stored in the storage part 5. The spray arm can include a lower spray arm 6, an upper spray arm 7 and a top nozzle 9.

The lower spray arm 6 can be rotatably provided below the lower rack 51 and configured to spray to the dishes. The upper spray arm 7 can be rotatably provided between the upper spray arm 7 and the lower rack 51 and configured to spray wash water to the dishes.

The lower spray arm 6 can be rotatably coupled to a top of the sump cover 42 and configured to spray wash water toward the dishes stored in the lower rack 51. The upper spray arm 7 can be disposed above the lower spray arm 6 and configured to spray wash water toward the dishes stored in the upper rack 53. The top nozzle 9 can be provided in an upper are of the washing space 21 and configured to spray wash water to the lower rack 51 and the upper rack 53.

As described above, the first water supply path 461 can be configured to supply wash water to the lower spray arm 6 and the second water supply path 463 can be configured to supply wash water to the upper spray arm 7 and the top nozzle 9.

Referring to FIG. 1, the dishwasher can include a base 8. The base 8 can be disposed underneath the tub 2 and the tub 2 can be secured to the base. The base 8 can provide a space in which the sump 4 is disposed, and also a space in which the pump, the dry air supplier and other various mechanisms are disposed.

Accordingly, the base 8 can have an outer wall to support the entire dishwasher and form a space to accommodate various devices.

Figure 2:
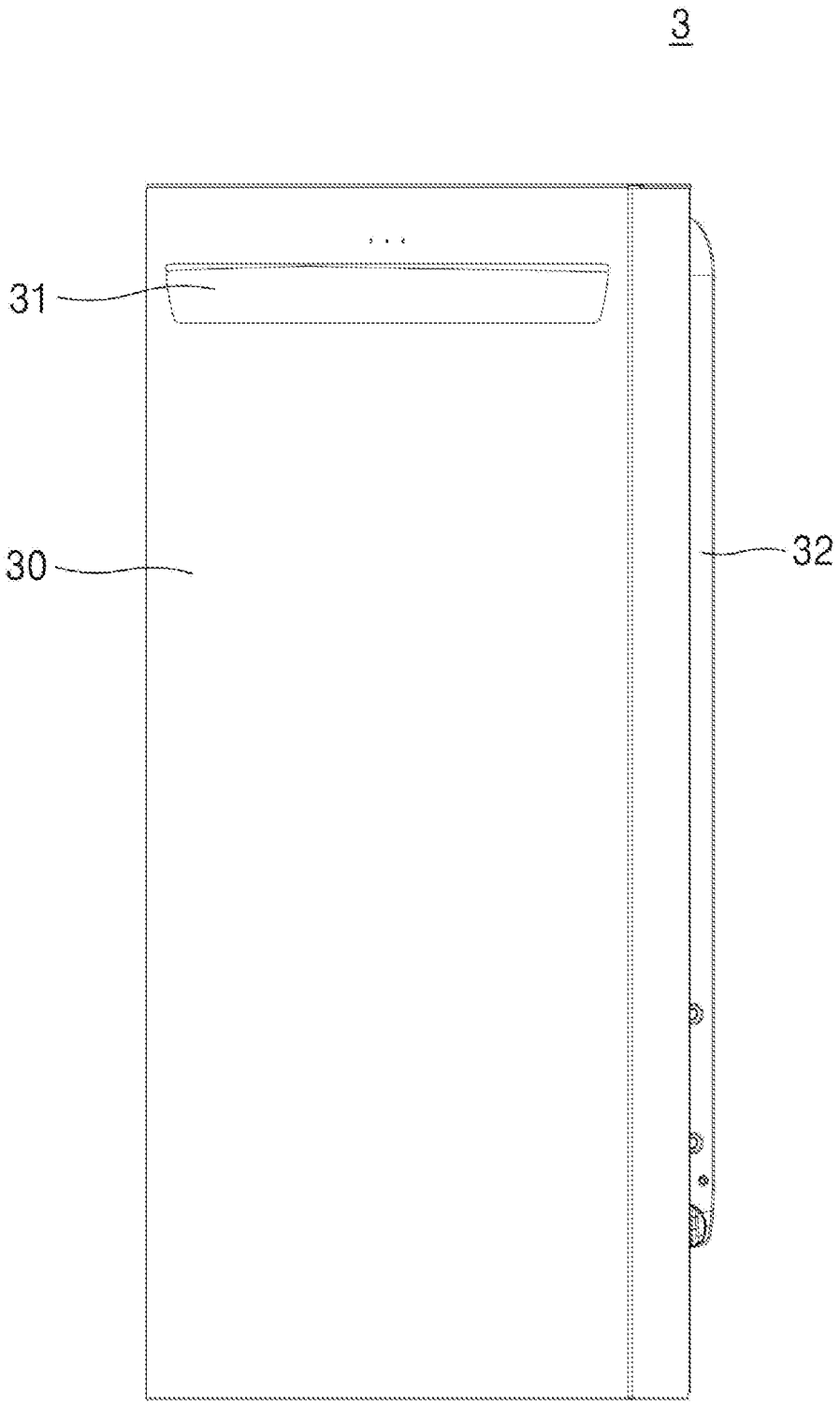
FIG. 2 is a perspective view showing an example of a door of the dishwasher.
Figure 3:
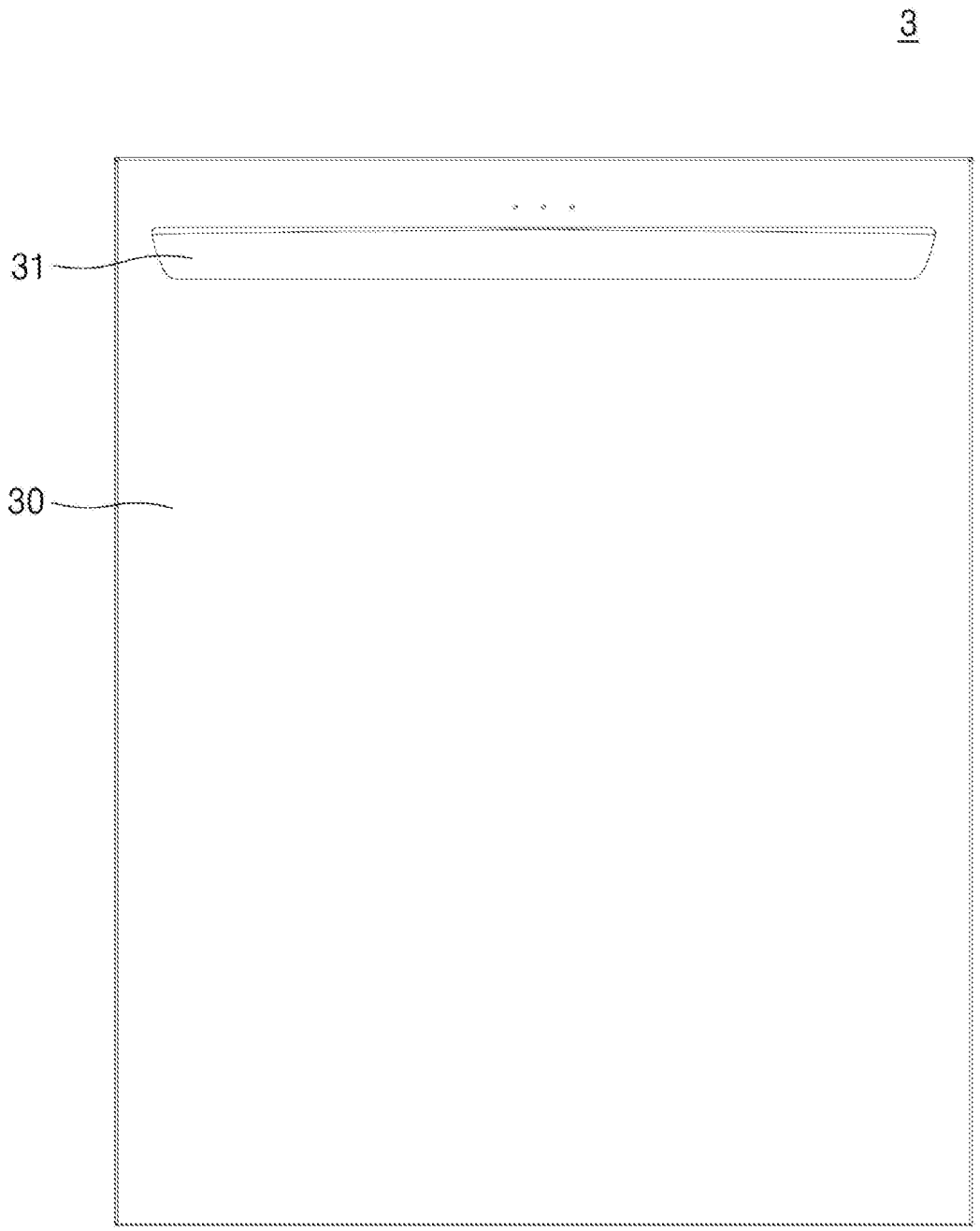
FIG. 3 is a front view of the door.
Figure 4:
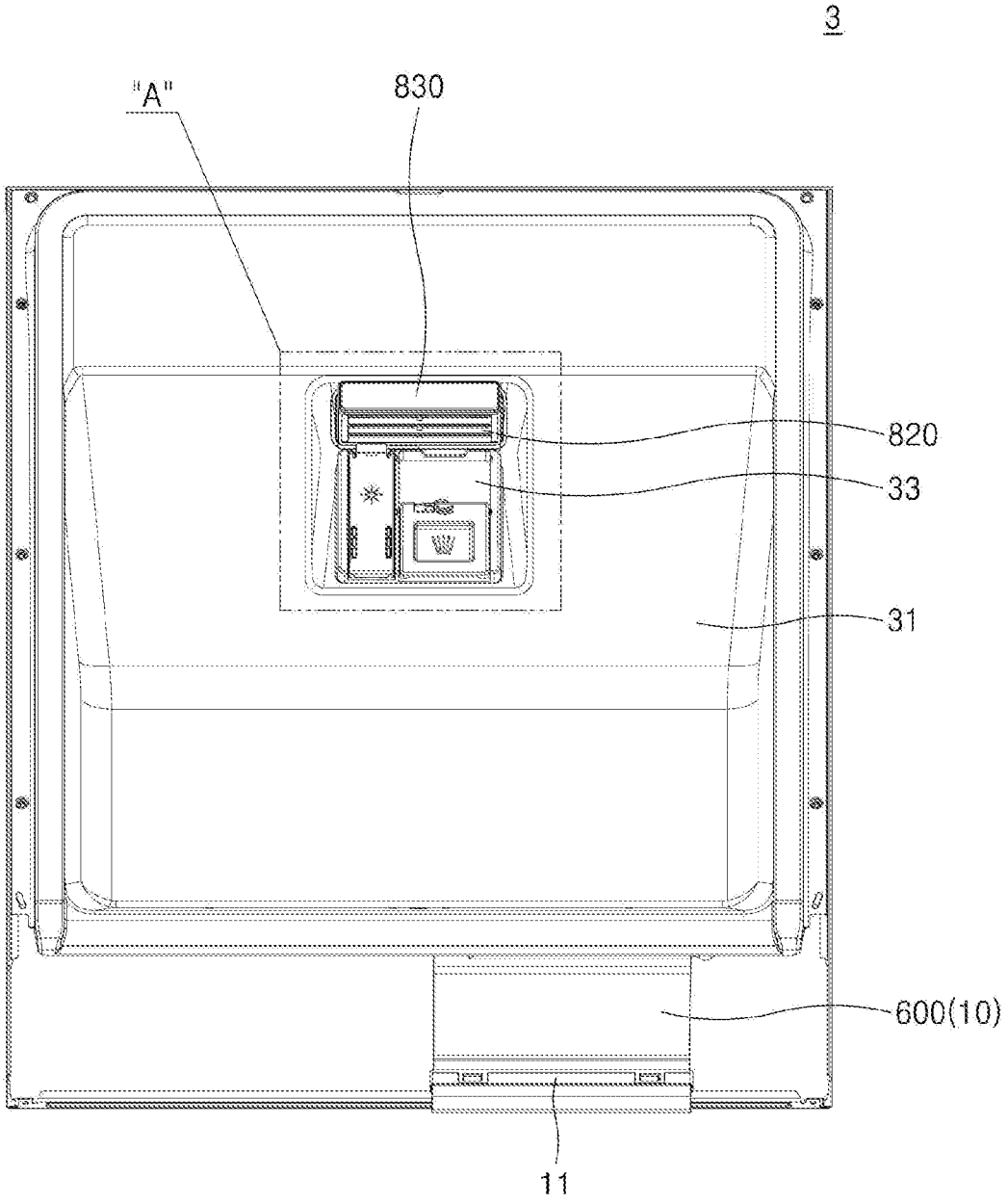
FIG. 4 is a rear view of the door.
Figure 5:
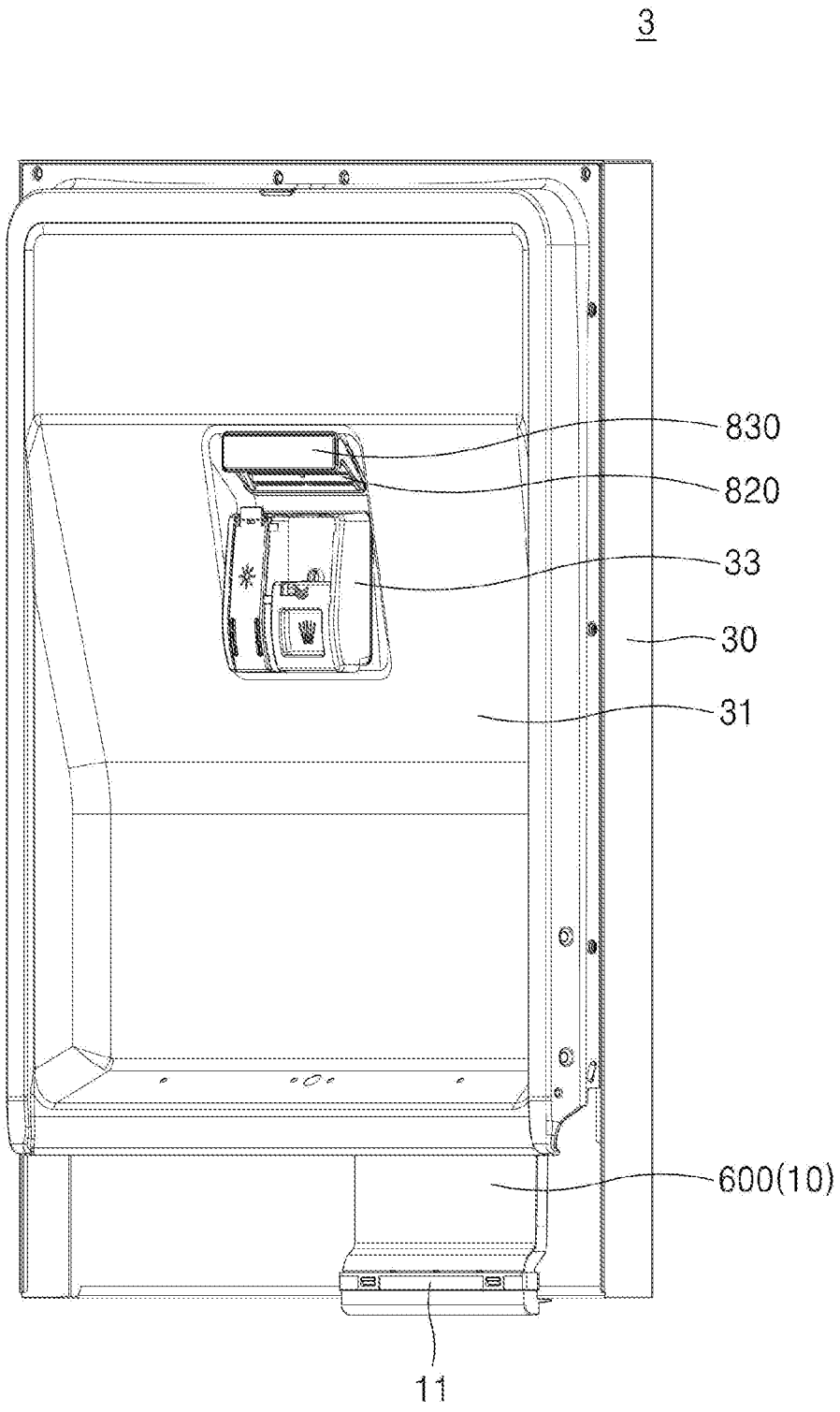
FIG. 5 is a rear perspective view of the door.
Figure 6:
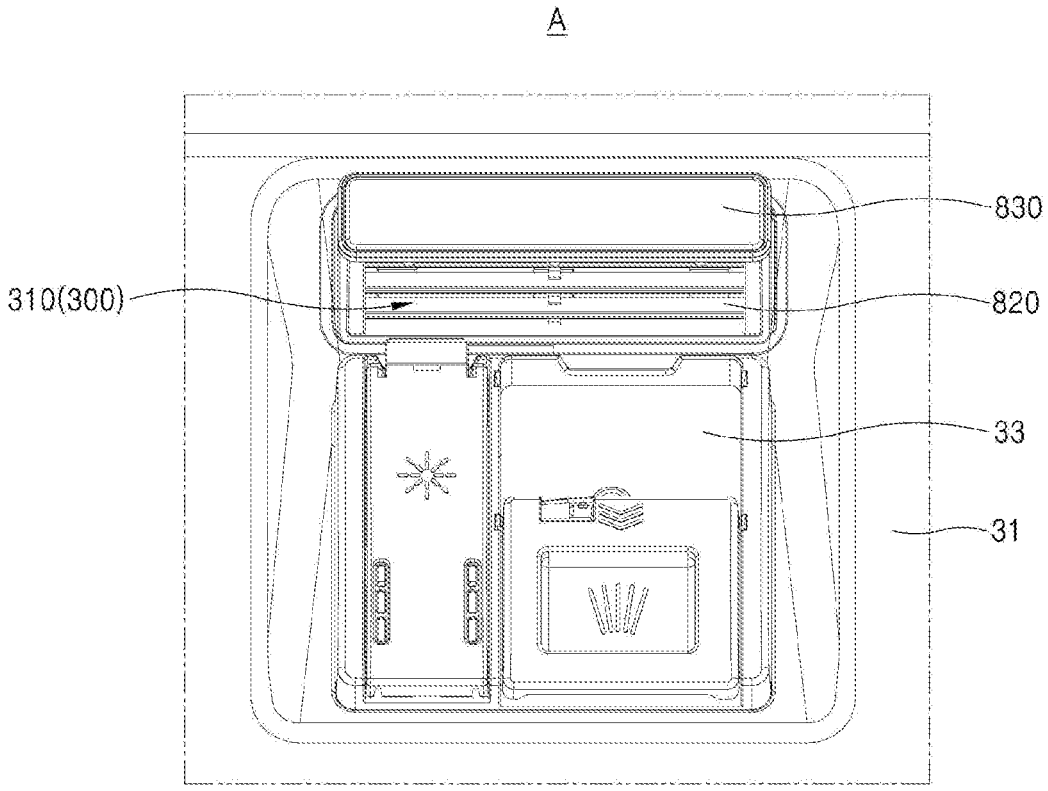
FIG. 6 is an enlarged view of 'A' shown in FIG. 4.

FIG. 2 is a perspective view showing a tub 2 and a base that are provided in a dishwasher. FIG. 3 is a front view of a door 3. FIG. 4 is a rear view of a door 3. FIG. 5 is a rear perspective view of a door 3. FIG. 6 is an enlarged view of 'A' shown in FIG. 4.

The door 3 can be coupled to the front of the tub 2 and configured to open and close the tub 2. The door 3 can open and close the tub based on rotation with respect to the tub 2. A handle can be secured to an outer surface of the door 3 so that the user can open and close the door 3, with holding the handle.

The door 3 can include a body 30 and a liner 32. The body 30 can be disposed in an outer area of the door 3 and the handle 31 can be secured to the body 30.

When the door 3 is closed to close the tub 2, the liner 32 can be configured to seal between the tub 2 and the body 30 of the door 3 so that the wash water inside the tub 2 may not leak to the outside of the dishwasher.

Accordingly, the liner 32 can be secured to an inner surface of the door 3 to seal between the tub 2 and the door 3. In some examples, an accommodation mechanism 33 can be provided on an inner surface of the liner 32 and a dishwashing detergent accommodated in the accommodation mechanism 33 can be introduced into the tub 2 as much as needed to be mixed with wash water.

A space 3*a* can be formed between the liner 32 of the door 3 and the body 30 and the drying device 10 can be provided inside the space 3*a*. A drying process can be performed by discharging water vapor inside the tub to the outside by operating the drying device 10 provided in the dishwasher.

The drying device 10 can be secured to the door 3 and configured to discharging the wet air flowing in from the inside of the tub 2 and the dry air flowing in from the outside of the tub 2, to as dry the inside the tub 2.

The drying device 10 can be mounted in a space defined between the body 30 and the liner 32. A mount portion 11 can be secured to a lower surface of the duct 600 and mounted to a lower surface of the body 30 so that the duct 600 can be stably secured to the lower area of the door 3.

Hereinafter, the wet air refers to air with a high humidity that flows in the drying device 10 from the inside of the tub 2. The dry air refers to air with a low humidity around the dishwasher that flows into the drying device 10 from the outside of the tub 2. The humidity of the wet air can be higher than that of the dry air.

In the following, unless otherwise specified, humidity refers to absolute humidity and relative humidity. In addition, mixed air refers to air that is made by mixing the wet air and the dry air described above with each other in the drying device 10. The humidity of the mixed air can be lower than that of the wet air and higher than the dry air.

The drying device 10 can operate after a heating and rinsing operation for rinsing the dishes stored in the tub 2 by heating wash water during a washing operation is performed.

The drying device 10 can be configured to mix the wet air flowing in from the inside of the tub 2 and the dry air flowing in from the outside of the tub 2 and then to discharge the mixed air to the outside of the dishwasher, thereby constantly lowering humidity inside the tub 2.

Accordingly, the drying device 10 can dry the dishes by discharging water vapor inside the tub 2 to the outside and evaporating wash water remaining on surfaces of the dishes stored inside the tub 2.

A third inlet 310 can be formed in the drying device 10 and configured to facilitate communication between the tub 2 and the inside of the drying device 10. The wet air inside the tub 2 can be introduced into the drying device 10 through the third inlet 310.

The third inlet 310 can be disposed on a surface directed from the liner 32 toward the tub 2. The drying device 10 can include a mesh member 820 coupled to the drying device 10 at a position corresponding to the third inlet 310.

The mesh member 820 can include a plurality of ribs. Accordingly, wet air can be introduced into the drying device 10 through the third inlet 310 but relatively large objects can be blocked from flowing into the drying device 10 by the mesh member 820.

The mesh member 820 can block a large object inside the tub 2 from flowing into the drying device 10. In addition, the mesh member 820 can suppress the user's finger from being suctioned into the drying device 10 through the third inlet 310 when the user touches the communication hole with the finger.

The drying device 10 can include a packing member 810 (see FIG. 10) and a name plate 830. The packing member 810 can be disposed between the mesh member 820 and a surface of the liner 32 and configured to seal a gap that may be formed between the mesh member 820 and the surface of the liner 32.

The name plate 830 can be coupled to a predetermined area of the mesh member 820. The name plate 830 can be coupled to the predetermined area of the mesh member 820 not to cover the third inlet 310. The name and function of the drying device 10 can be written on the name plate 830.

Figure 7:
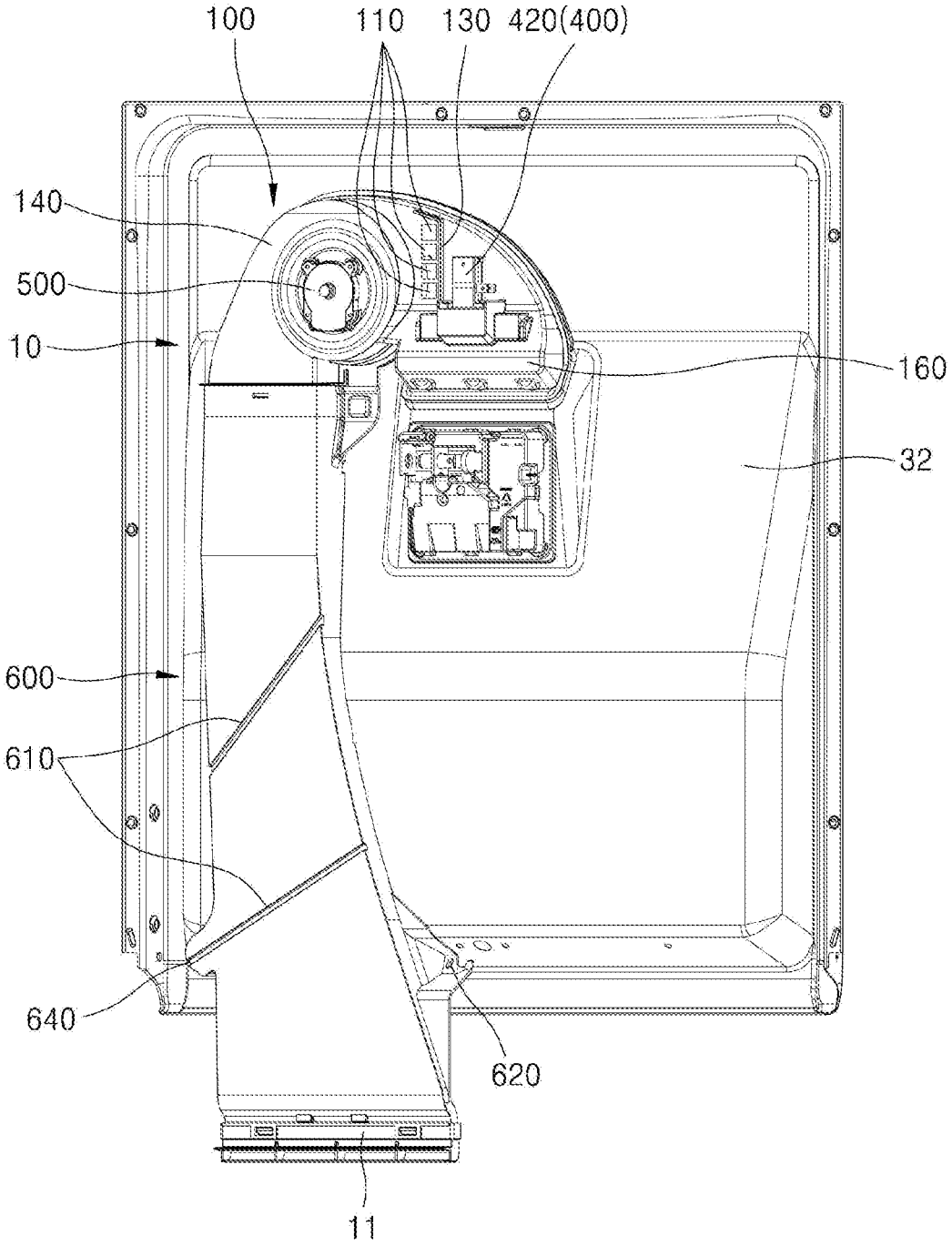
FIG. 7 is a view showing a state where a body is cut away from the door.
Figure 8:
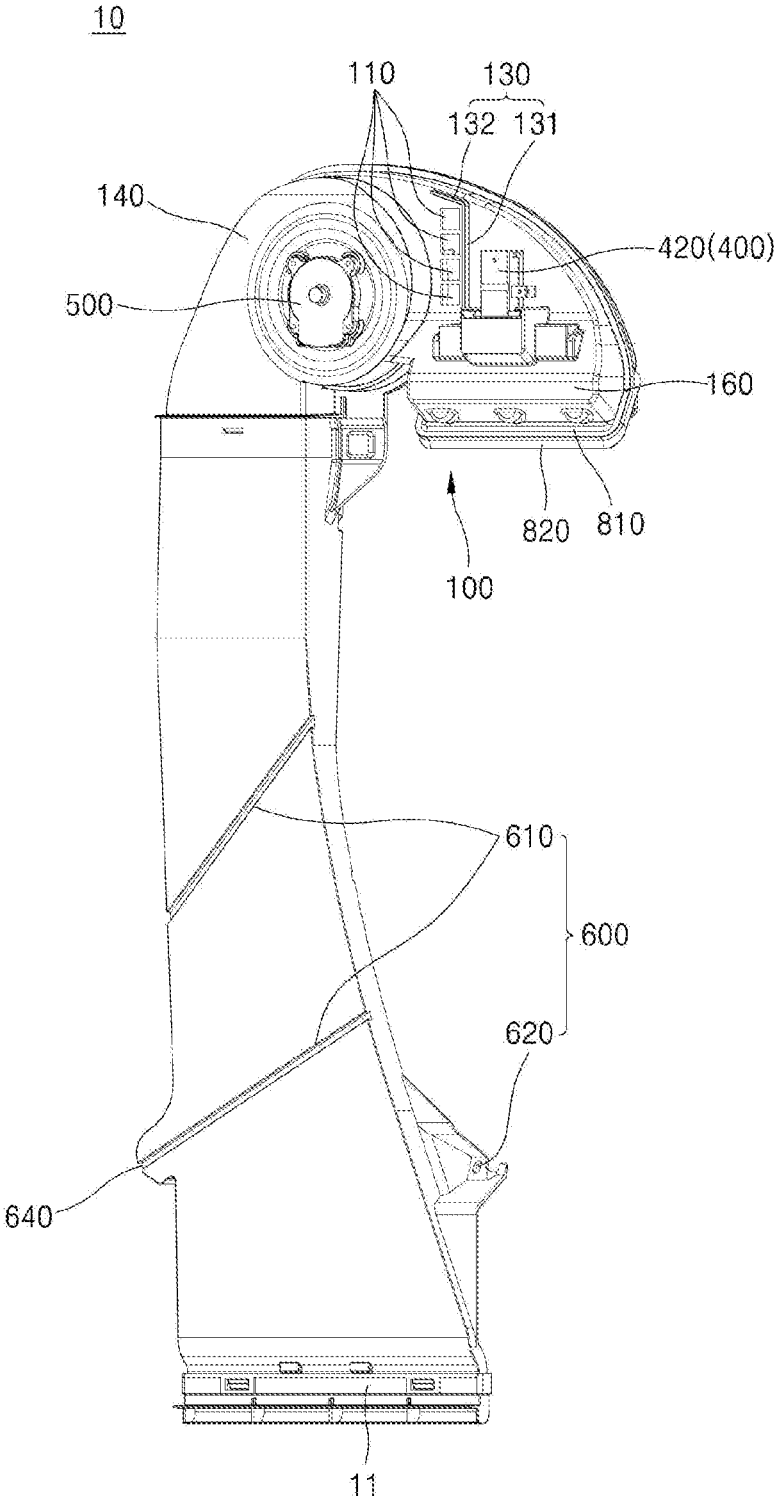
FIG. 8 is a perspective view showing an example of a drying device.
Figure 9:
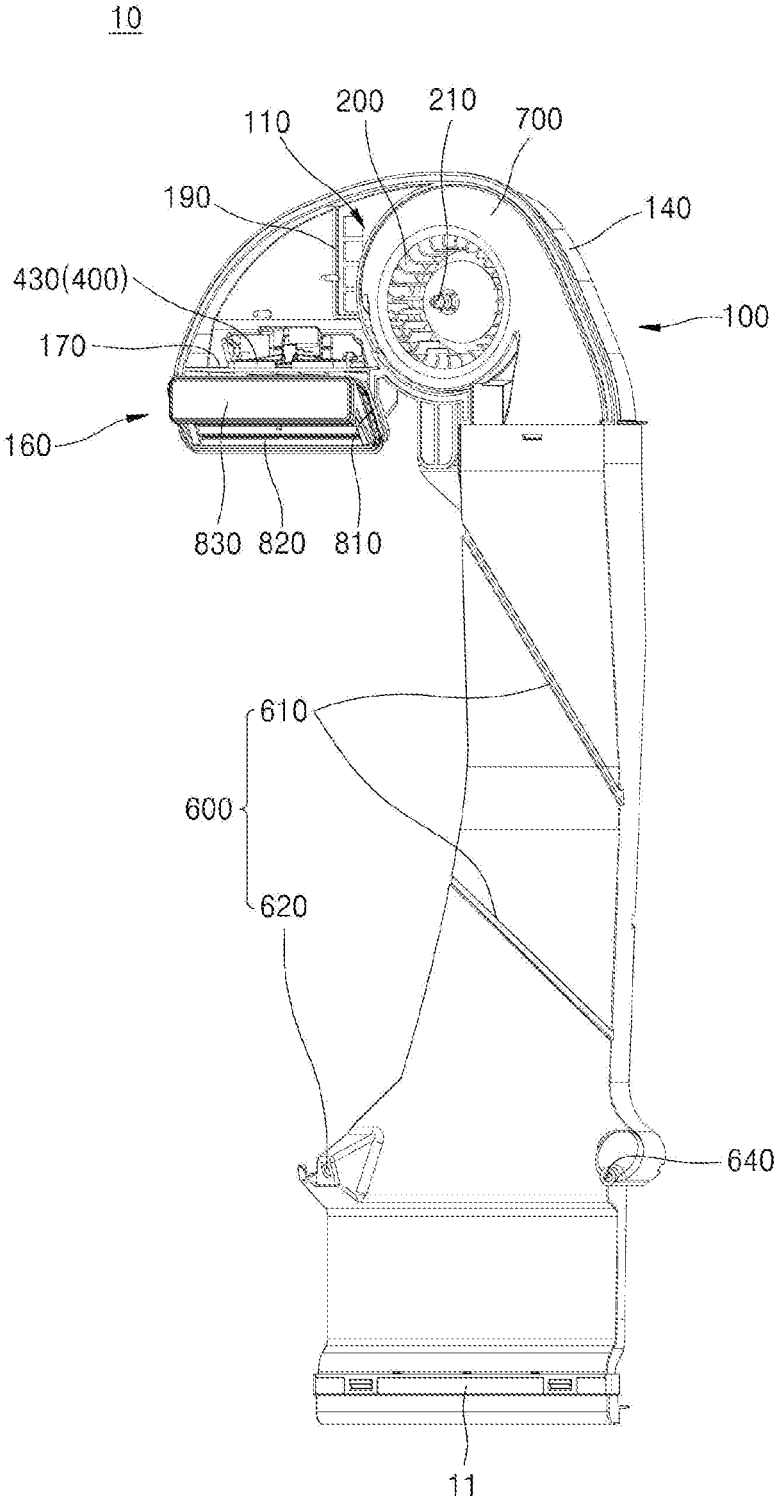
FIG. 9 is a view from a different direction, omitting a cover from FIG. 9.

FIG. 7 shows a door body 30 cut away from a door 3. FIG. 8 is a perspective view showing a drying device 10. FIG. 9 is a view of FIG. 8, viewed in a different direction, without a cover. A cover 300 is omitted in FIG. 9.

Figure 10:
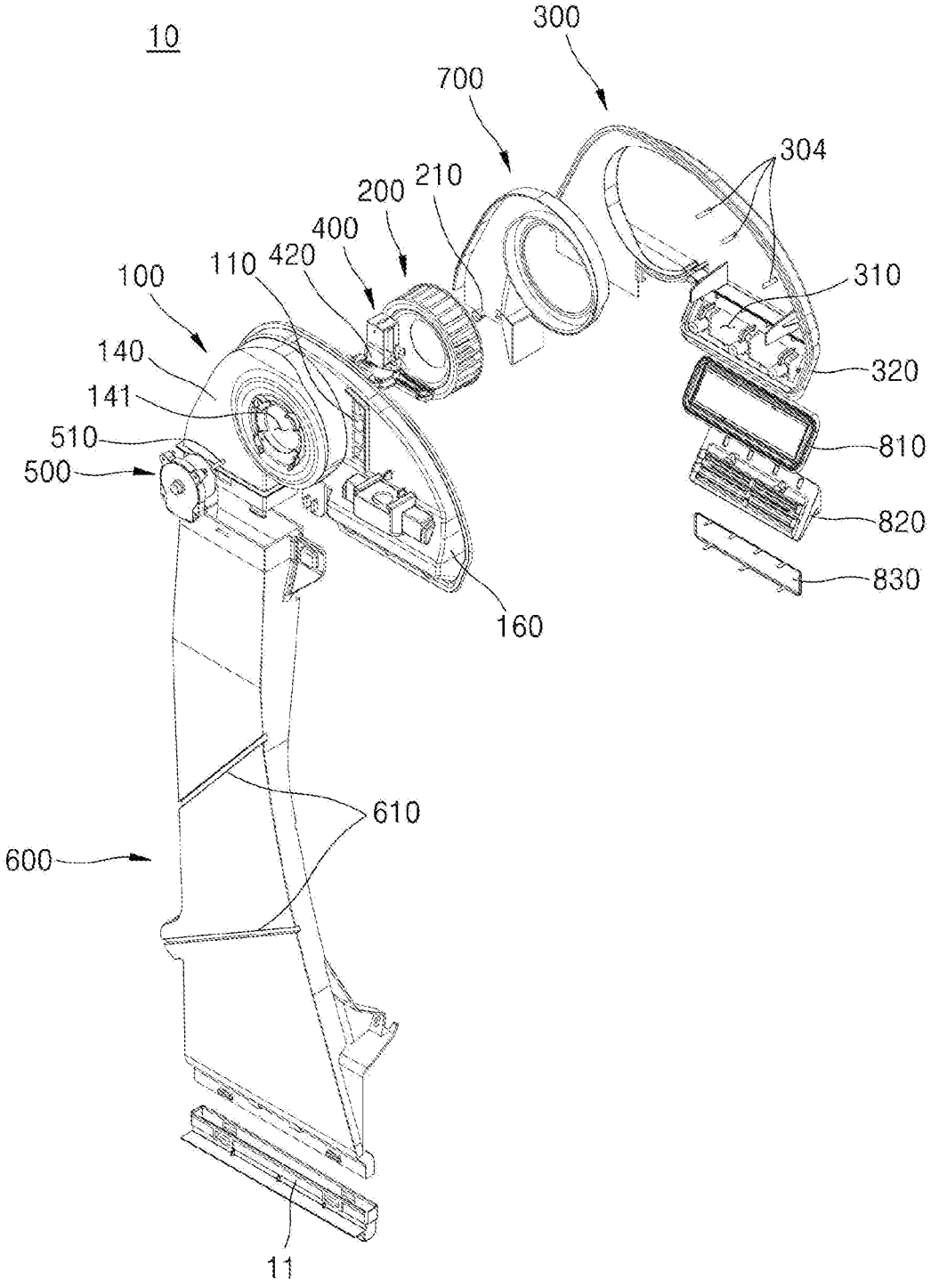
FIG. 10 an exploded perspective view showing the drying device.
Figure 11:
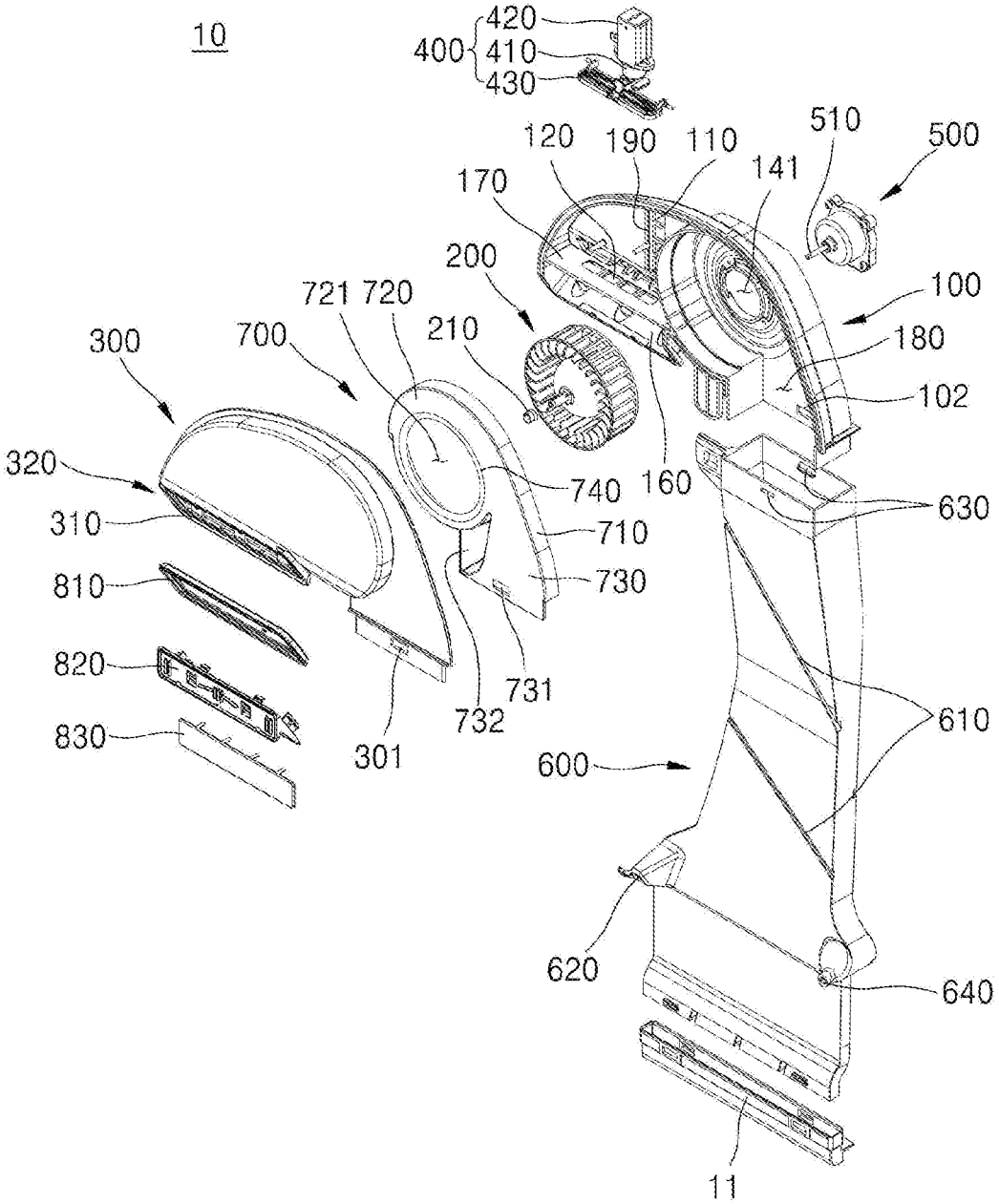
FIG. 11 a view of FIG. 10, viewed from a different direction.

FIG. 10 is an exploded perspective view showing a drying device 10. FIG. 11 is a view of FIG. 10, viewed in a different direction.

The drying device 10 can include a bracket 100, an impeller 200 and a cover 300. The bracket 100 can be configured to provide a certain space in which the wet air and the dry are flow.

The wet air and the dry air can separately flow in the bracket 100, and can be mixed to be the mixed air before flowing in the impeller 200 from the inside of the bracket 100. The mixed air can be more mixed to be introduced into the duct 600, while passing through the impeller 200.

The impeller 200 can be secured to the bracket 100 and configured to forcibly flow the mixed air made from the wet air and the dry air. The wet air and the dry air can be introduced into the bracket 100 by the impeller 200 to be mixed. The mixed air can be discharged to the outside of the duct 600 through the bracket 100, the impeller 200 and the duct 600 sequentially.

The cover 300 can be coupled to the bracket 100 and configured to receive a valve mechanism 400 and the impeller 200. The cover 300 coupled to the bracket 100 can provide an airflow space in which the wet air and the dry air flow.

The cover 300 can include a second support portion 304. The second support portion 304 can protrude from an inner wall of the cover 300 toward the bracket 100, and can be provided in plural. The plurality of second support portions 304 can be spaced an appropriate distance apart from each other.

The second support portion 304 can function to stably support the components mounted in the drying device 10, together with the first support portion 105 formed in the bracket 100.

The bracket 100 can include a first inlet 110 disposed to communicate with the outside of the drying device 10 and receive the dry air. The first inlet 110 can be directly connected to the atmosphere so that ambient air can be introduced into the drying device 10 through the first inlet 110. The dry air can be the ambient atmosphere.

Referring to FIG. 8, the first inlet 110 can include a plurality of holes penetrating the bracket 100. The plurality of the holes constituting the first inlet 110 can be spaced apart from each other and disposed in a vertical direction of the bracket 100. As the impeller 200 rotates, dry air can flow in the bracket 100 through the first inlet 110 and can be mixed with wet air to be the mixed air. The mixed air can flow into the impeller 200.

The bracket 100 can include a second inlet 120 spaced apart from the first inlet 110, in communication with the tub 2, and configured to receive the wet air. The second inlet 120 can be closed and opened by the valve mechanism 400.

When the drying device 10 operates, the valve mechanism 400 can open the second inlet 120 and wet air inside the tub 2 can flow into the bracket 100 through the second inlet 120 to be mixed with dry air.

The drying device 10 can include the valve mechanism 400, the duct 600 and an air guide 700.

The valve mechanism 400 can be secured to the bracket 100 and disposed in a path of the wet air, and can be configured to open and close the second inlet 120.

The valve mechanism 400 can open and close the second inlet 120 to allow wet air to flow into the drying device 10 from the duct 600 through the second inlet or block the wet air flow: In some implementations, the valve mechanism 400 can be provided in plural and some of the valve mechanism 400 can be open or all of the valve mechanism 400 can be open.

Accordingly, the plurality of valve mechanisms 400 can adjust an open rate of the second inlet 120 to control the flow rate of the wet air flowing into the drying device 10 from the tub 2. Hereinafter, an example having one valve mechanism 400 will be described.

In some implementations, the duct 600 can communicate with the bracket 100 and an outlet of the cover 300, and can provide a passage for discharging the mixed air to the outside from the impeller 200. An inlet of the duct 600 can be in communication with a first outlet 180, and an outlet of the duct 600 can be directly connected to the atmosphere. Accordingly, the mixed air discharged from the outlet of the duct 600 can be more humid than ambient air.

The duct 600 can have an inducing portion 610 and a recollecting hole 640. In some examples, a plurality of inducing portions 610 can be disposed on an inner wall of the duct 600 in a direction in which the mixed air flows, and configured to drop the condensate generated on the inner wall of the duct 600 to the lower area. The recollecting hole 640 can be defined below the inducting portion 610, in communication with the tub, and configured to provide a passage along which the dropped condensate is recollected in the tub 2.

In some examples, the plurality of inducing portions 610 can include a plurality of protrusions protruded toward the inside of the duct and spaced a predetermined distance apart from each other along the flowing direction of the mixed air. The inducing portion 610 can extend in a longitudinal direction that is inclined with respect to a direction in which gravity acts. The recollecting hole 640 can be defined at a position corresponding to a lowermost end of the inducing portion 610 so that the condensed falling along the inducing portion 610 can easily reach the recollecting hole 640.

Dew condensation may occur in that water is condensed from the mixed air flowing inside the duct 600 to generate dew on the inner wall of the duct 600. While falling by gravity, the condensate generated on the inner wall can flow downward along the longitudinal direction of the inducing portion 610 protruded from the inner wall of the duct 600, and can be collected in the lower area of the duct 600.

The condensate collected in the lower area of the duct 600 can flow through the recollecting hole 640. A hose, for example, can be secured to the recollecting hole 640 and the hose can be in communication with the inside of the tub 2.

Accordingly, the condensate flowing downward along the inducing portion 610 can sequentially pass through the recollecting hole 640 and the hose, to be recollected in the tub 2. The condensate recollected inside the tub 2 can be introduced into the sump disposed below the tub 2. Due to this structure, the condensate generated on the inner wall of the duct 600 can be recollected in the tub 2.

In some examples, the duct 600 can have a coupling hole 620 formed at a position distant from the recollecting hole 640 and a coupling member such as a bolt for coupling the duct 600 to the door 3 can be coupled to the coupling hole 620.

The air guide 700 can be disposed between the bracket 100 and the cover 300 so that the impeller 200 can be rotatably coupled to the air guide, and can be configured to guide the flow of the mixed air introduced into the impeller 200.

The air guide 700 can guide the mixed air forcibly flowing by the impeller 200 to flow along a preset flow direction and seal the impeller 200 to suppress the wet air from leaking to another space after escaping the preset flow passage between the bracket 100 and the cover 300.

The bracket 100 can include a first communication portion 160, a partition wall 170 and a first outlet 180. The first communication portion 160 can form a space that is in communication with the cover 300. The first communication portion 160 can be coupled to a second communication portion 320 formed in the cover 300 to form a flow space of wet air. The wet air flowing into the airflow space can flow in the impeller 200 through the second inlet 120.

The second inlet 120 can be formed in the partition wall 170 and the partition wall 170 can be configured to partition off the first communication portion 160 from the inner space of the bracket 100. Referring to FIG. 11, the first communication portion 160 and the inner space of the bracket 100 can be separated by the partition wall 170, and a plurality of second inlets 120 can be formed in the partition wall 170. The plurality of second inlets 120 can be opened and closed by an opening/closing portion 430 of the valve mechanism 400.

The first outlet 180 can be configured to discharge the mixed air having passed the impeller 200. The first outlet 180 can be coupled to the cover 300 to form an area for discharging the mixed air. Accordingly, an outlet having a shape corresponding to the first outlet 180 can be formed even in the cover 300.

The cover 300 can include a second communication portion 320 and a third inlet 310. The second communication portion 320 can be coupled to the first communication portion 160 and configured to form a space that is in communication with the bracket 100. The third inlet 310 can be configured to facilitate communication between the second communication portion 320 and the tub 2 so that the wet air can flow into the drying device 10 from the tub 2.

When the impeller 200 operates in a drying process, the wet air inside the duct 600 can be introduced into the bracket 100 after sequentially passing through the third inlet 310, the space in which the first communication portion 160 and the second communication portion 320 are formed, and the second inlet 120.

The valve mechanism 400 can include a valve portion 410, a valve control module 420, and an opening/closing portion 430. The valve portion 410 can be configured to operate the opening/closing portion 430 to open and close the second inlet 120 provided in the bracket 100.

The valve control module 420 can be secured to the valve portion 410 and configured to control the operation of the valve portion 410. The valve control module 420 can operate the valve portion 410 and the valve portion 410 can operate the opening/closing portion 430, to open and close the second inlet 120.

The opening/closing portion 430 can be coupled to the valve portion 410 and configured to get in contact with the partition wall 170 or get distant from the partition wall 170 based on the operation of the valve portion 410, to open and close the second inlet 120.

When the dishwasher performs the drying process, the opening/closing portion 430 can be spaced apart from the partition wall 170 by the valve control module 420 and then the second inlet 120 can be open so that wet air can flow into the drying device 10 through the second inlet 120.

When the drying process of the dishwasher is completed, the opening/closing portion 430 can get in contact with the partition wall 170 by the valve control module 420 and then the second inlet 120 can be closed so that wet air inside the tub 2 can be blocked from flowing into the drying device 10.

The bracket 100 can include a casing 140 configured to form a mounting space of the impeller 200 and having a first through-hole 141 in a rotation axial direction of the impeller 200. The casing 140 can be integrally formed with the bracket 100.

In some examples, a motor 500 can be coupled to a shaft of the impeller 200 and configured to rotate the impeller 200. The impeller 200 can be secured to the casing 140 inside the bracket 100, and some area of the motor 500 can be exposed to the outside.

The impeller 200 can include a first shaft 210 protruding from the impeller 200. The first shaft 210 can be provided at the rotational center of the impeller 200. The motor 500 can further include a second shaft 510 provided at the rotational center of the motor 500.

The first shaft 210 can be hollow. As the second shaft 510 is inserted in the hollow of the first shaft 210, the motor 500 and the impeller 200 can be coupled to each other. Accordingly, the first shaft 210 and the impeller 200 can rotate along with the rotation of the second shaft 510 of the motor 500.

The motor 500 can be inserted in the first through-hole 141 to be coupled to the impeller 200 and some area of the motor 500 can be exposed to the outside of the casing 140 to be coupled to the casing 140 of the bracket 100 at a position adjacent to the first through-hole 141.

The wet air flowing into the drying device 10 from the tub 2 can be relatively high temperature and the dry air flowing into the drying device 10 can be relatively low temperature.

When the high temperature wet air and the low temperature dry air are mixed, condensation may occur in the wash water existing in a vapor state in the high-temperature wet air to make a condensate that is condensed water. The condensate can be condensed on an inner wall of the drying device 10 and fall by gravity.

The condensed water falling by gravity may accumulate on the floor of the location where the dishwasher is installed through an outlet of the mixed air. The accumulated condensate might cause inconvenience in that the user has to manually remove and wipe it out. Accordingly, there is a need of a structure configured to suppress the occurrence of dew condensation in the drying device 10.

In order to suppress the occurrence of dew condensation in the drying device 10, it is appropriate that the mixing of dry air and wet air occurs smoothly inside the drying device 10.

If wet air and dry air are hardly mixed in the drying device 10, the wet air in a state of being hardly mixed may be condensed on an inner wall of the drying device 10 due to its high humidity, thereby causing serious dew condensation inside the drying device 10.

Hereinafter, there will be described a structure according to the present disclosure that is configured to facilitate smooth mixing of the wet air flowing in from the tub 2 and the dry air flowing from the outside of the drying device 10.

Figure 12:
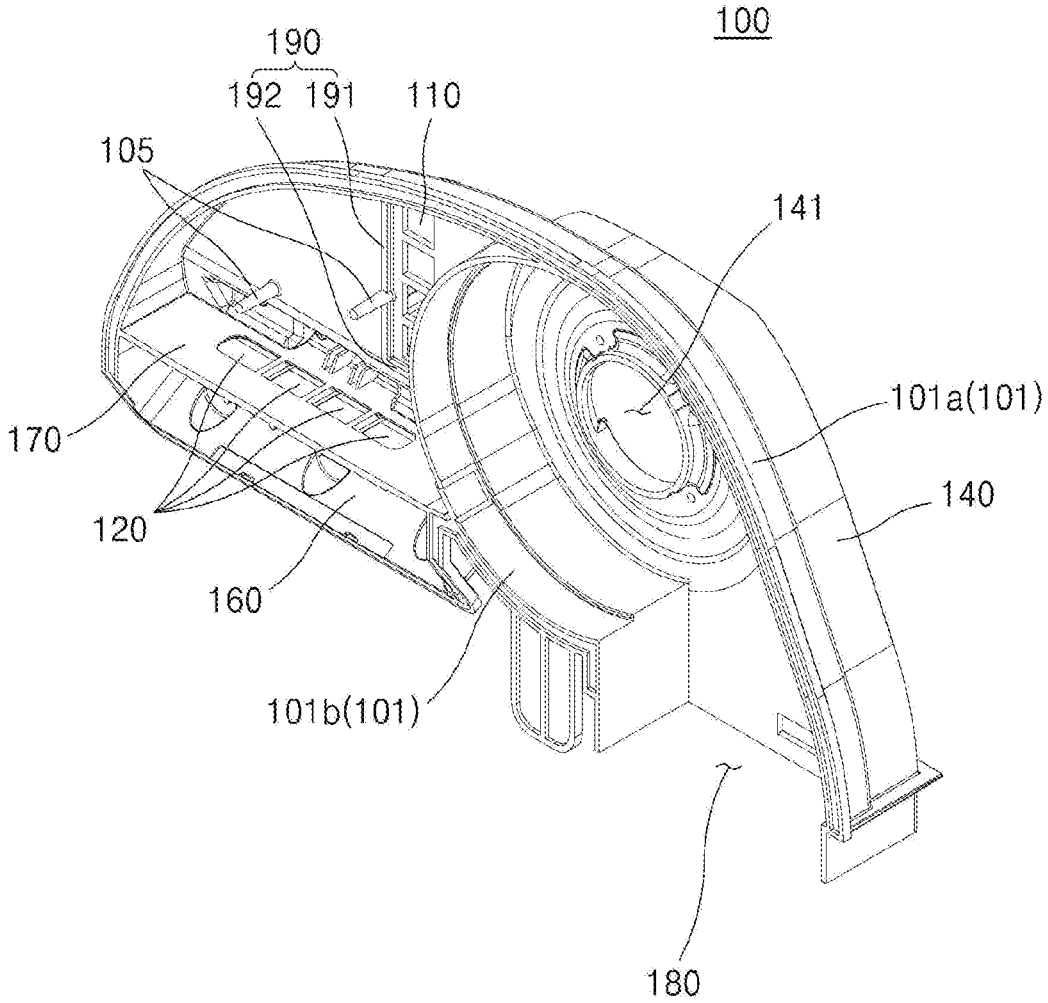
FIG. 12 is a perspective view showing an example of a bracket.

FIG. 12 is a perspective view showing a bracket 100.

The bracket 100 can include a first support portion 105. The first support portion can protrude toward the cover 300 from an inner wall of the bracket 100, and can be provided in plural. The plurality of first support portions 105 can be spaced a preset distance apart from each other. The first support portion 105 can function to stably support the components mounted in the drying device 10, together with a second support portion 304 formed in the cover 300. At least one of the plurality of first support portions 105 can be formed to overlap with a second blocking wall 190.

Specifically, the first support portion can protrude from the second blocking wall 190. The first support portion 105 can have a thin long shape to have a relatively weak rigidity. The first support portion 105 can overlap with the second blocking wall 190 so that the rigidity of the first support portion 105 can be reinforced and damage to the first support portion 105 due to the weak rigidity may be prevented.

The first inlet 110 can be disposed at a position in front of an entrance of the impeller 200 with respect to the flow path of the dry air.

Accordingly, the dry air flowing into the bracket 100 through the first inlet 110 and the wet air flowing into the bracket 100 through the second inlet 120 can met each other before they flow in the impeller 200. In other words, the dry air and the wet air before flowing in the impeller 200 can meet each other to be the mixed air.

Due to this structure, the dry air and the wet air can be mixed to be the mixed air, before flowing into the impeller 200. While passing through the impeller 200, the dry air and wet air contained in the mixed air can be more mixed to be mixed air that is mixed more uniformly.

The flow direction of the dry air in the first inlet 110 can be formed to cross the flow direction of the wet air in the second inlet 120.

The wet air passing through the second inlet 120 can flow along a vertical direction of the bracket 100. The first inlet 110 can be formed to penetrate the bracket 100 in a lateral direction of the bracket 100. Accordingly, the dry air introduced into the bracket 100 through the first inlet 110 can flow along the lateral direction of the bracket 100.

Accordingly, the dry air and the wet air can have the flow directions that cross each other at a point where they meet. When the flow directions of the dry and the wet air cross each other, the mixing efficiency of the dry air and the wet air can be more enhanced, compared with the flow directions parallel to each other.

When the flow directions cross each other, the dry air and the wet air can flow in the respective flow paths crossing each other. Accordingly, the dry air and the wet air can be more mixed as cutting off the flow paths, compared to flow directions that are parallel to each other.

In some implementations, the dry air and the wet air can be mixed to be the mixed air at a position before flowing into the impeller 200. The mixed air can be more mixed while passing through the impeller 200, to remarkably enhance the mixing efficiency of the dry air and the wet air.

In some implementations, the flow directions at the position where the dry air and the wet air meet cross each other so that the dry air and the wet air can be noticeably increased.

Since the mixed sufficiently mixed is introduced into the duct 600, dew condensation inside the duct 600 can be effectively suppressed.

Referring to FIG. 8, at least predetermined area of the valve control module 420 can be disposed outside the bracket 100 to be connected to an external power supply, a communication wire and etc.

The water vapor contained in the bracket 100 of the drying device 10 and the condensate condensed on the inner wall of the bracket 100 can be discharged to the outside through the first inlet. For example, the discharged water might penetrate the components disposed outside the drying device 10, particularly, the valve control module 420, and might adversely affect the valve control module 420.

As shown in FIG. 8, the bracket 100 can include a first blocking wall 130 provided to protrude from an outer surface of the bracket 100 and configured to surround at least predetermined area of the first inlet 110.

At least predetermined area of the first blocking wall 130 can be disposed between the first inlet 110 and the valve control module 420, to suppress the wet air discharged through the first inlet 110 from flowing toward the valve control module 420.

The wet air introduced into the drying device 10 from the tub 2 through the second inlet 120 can be partially discharged to the outside of the drying device 10 through the first inlet 110. The wet air discharged from the first inlet 110 might corrode components of the valve control module 420, when it flows to the valve control module 420.

Accordingly, the first blocking wall 130 can protrude to an outer surface of the bracket 100, and can be disposed between the first inlet 110 and the valve control module 420 to block the wet air discharged through the first inlet 110 from flowing to the valve control module 420.

In some examples, the height of the first blocking wall 130 can be selected appropriately to effectively block the airflow to the valve control module 420 from the first inlet 110 from the first inlet 110 and to prevent the overall volume of the bracket 100 from becoming excessively large.

The first blocking wall 130 can include a first cell 131 and a second cell 132. The first cell 131 can be disposed between the first inlet 110 and the valve control module 420. The second cell 132 can be bent from a lower end of the first cell 131 and configured to surround the first inlet 110.

The first cell 131 and the second cell 132 can be disposed to surround some area of the first inlet 110, to effectively block flow of wet air between the first inlet 110 and the valve control module 420.

The second cell 132 can be inclined with respect to a vertical direction of the bracket 100. In some examples, the second cell 132 can be disposed upward as getting closer to an end thereof.

Due to this structure, even if a condensate is generated on an upper surface or a lower surface of the second cell 132, the condensate can fall along the inclination of the second cell and flow into the first inlet again or fall below the bracket 100 along the first cell connected to the second cell 132. Accordingly, the condensate can be suppressed from flowing out from the first inlet 110 to the outside.

In addition, a control panel can be disposed on an upper portion of the door 3 and configured to control the dishwasher. The second cell 132 can block an upper area of the first inlet 110 to effectively prevent a condensate or wet air, which might leak into the control panel above the second cell 132 through the first inlet, from reaching the control panel.

In some implementations, the first blocking wall 130 can effectively block the wet air discharged through the first inlet 110 from flowing to the valve control module, thereby suppressing the valve control module 420 from being corroded by the wet air.

As shown in FIG. 12, the bracket 100 can include a second blocking wall 190 protruding from an inner surface of the bracket 100 and configured to surround at least predetermined area of the first inlet 110.

The first blocking wall 130 and the second blocking wall 190 can be configured to effectively reinforce the rigidity of the bracket 100, which becomes insufficient due to the formation of the first inlet.

At least predetermined area of the second blocking wall 190 can be disposed between the first inlet 110 and the valve control module 420 so suppress the condensate condensed on the inner wall of the bracket 100 from flowing out through the first inlet 110.

The condensate generated by the dew condensation can be stuck to the inner wall of the bracket 100. Some of such the condensate can be discharged to the outside of the drying device 10 through the first inlet 110. If the condensate discharged from the first inlet 110 can flow to the valve control module 420 along an outer surface of the bracket 100, the components of the valve control module 420 might be corroded.

Accordingly, the second blocking wall 190 can protrude from the inner surface of the bracket 100 and can be disposed between the first inlet 110 and the valve control module 420, to suppress the condensate from flowing out through the first inlet 110.

The second blocking wall 190 can suppress the condensate from flowing out through the first inlet 110, thereby effectively blocking the condensate discharged from the first inlet 110 from flowing to the valve control module 420.

In some examples, the height of the second blocking wall 190 can be selected appropriately to effectively block the condensate from flowing out through the first inlet 110 from the inner wall of the bracket 100 without significantly impeding the flow of the dry air and the wet air inside the bracket 100.

The second blocking wall 190 can include a first part 191 and a second part 192. The first part 191 can be disposed between the first inlet 110 and the valve control module 420. The second part 192 can be bent from a lower end of the first part 191 and configured to surround the first inlet 110.

The first part 191 and the second part 192 can be configured to partially surround the first inlet 110 so that the condensate generated on the inner wall of the bracket 100 can flow out to the outside of the bracket 100 through the first inlet 110, thereby effectively blocking the condensate from flowing to the valve control module 420.

In some implementations, the second blocking wall 190 can be configured to block the condensate generated on the inner wall of the bracket 100 from being discharged to the outside through the first inlet 110. Accordingly, the condensate can be blocked from flowing to the valve control module after being discharged through the first inlet 110 to effectively suppress corrosion of the valve control module 420.

In some examples, the second part 192 can be disposed between the first inlet 110 and the third inlet 310. Accordingly, even if the wash water sprayed from the spray arms 6, 7, and 9) comes into the drying device through the mesh member 820, the third inlet 310 and the second inlet 120, the wash water can be prevented from flowing out through the first inlet 110.

Figure 13:
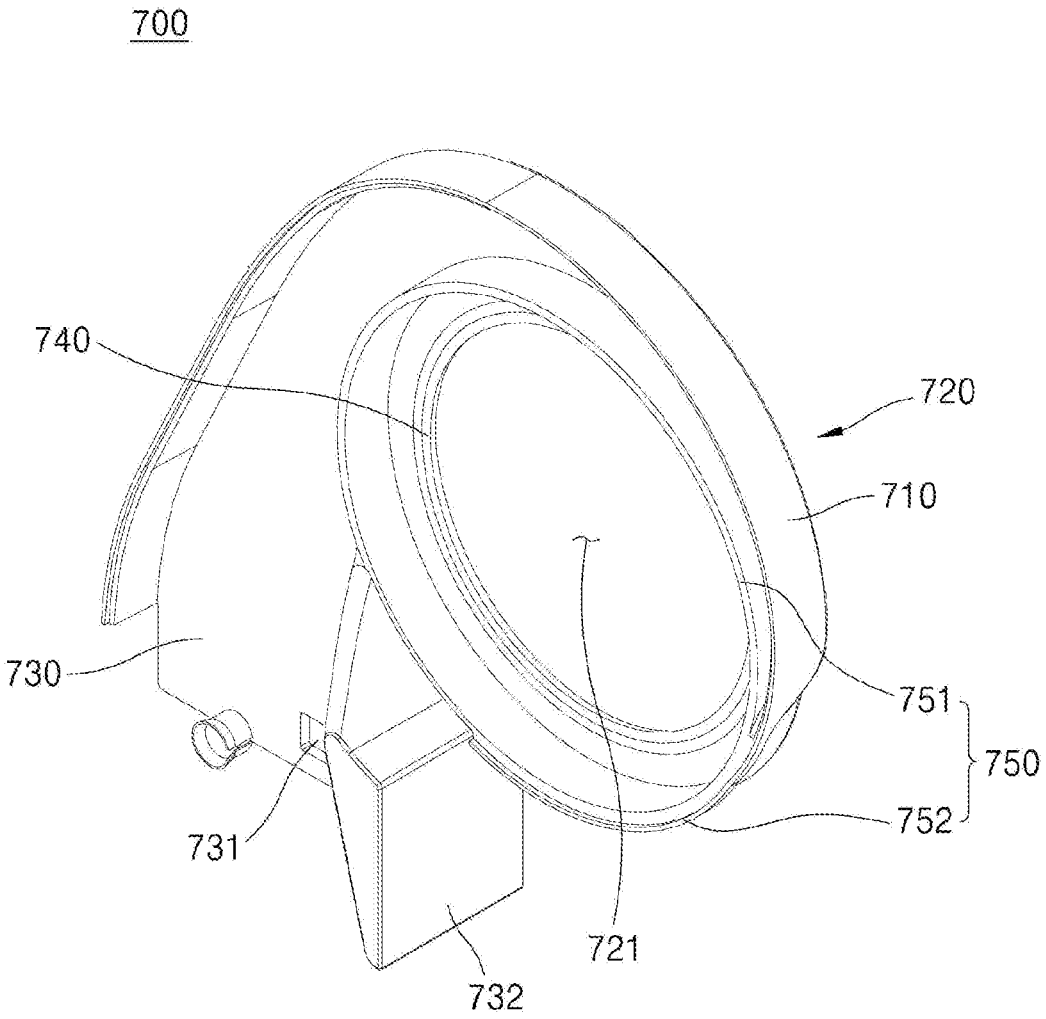
FIG. 13 is a perspective view showing an example of an air guide.
Figure 14:
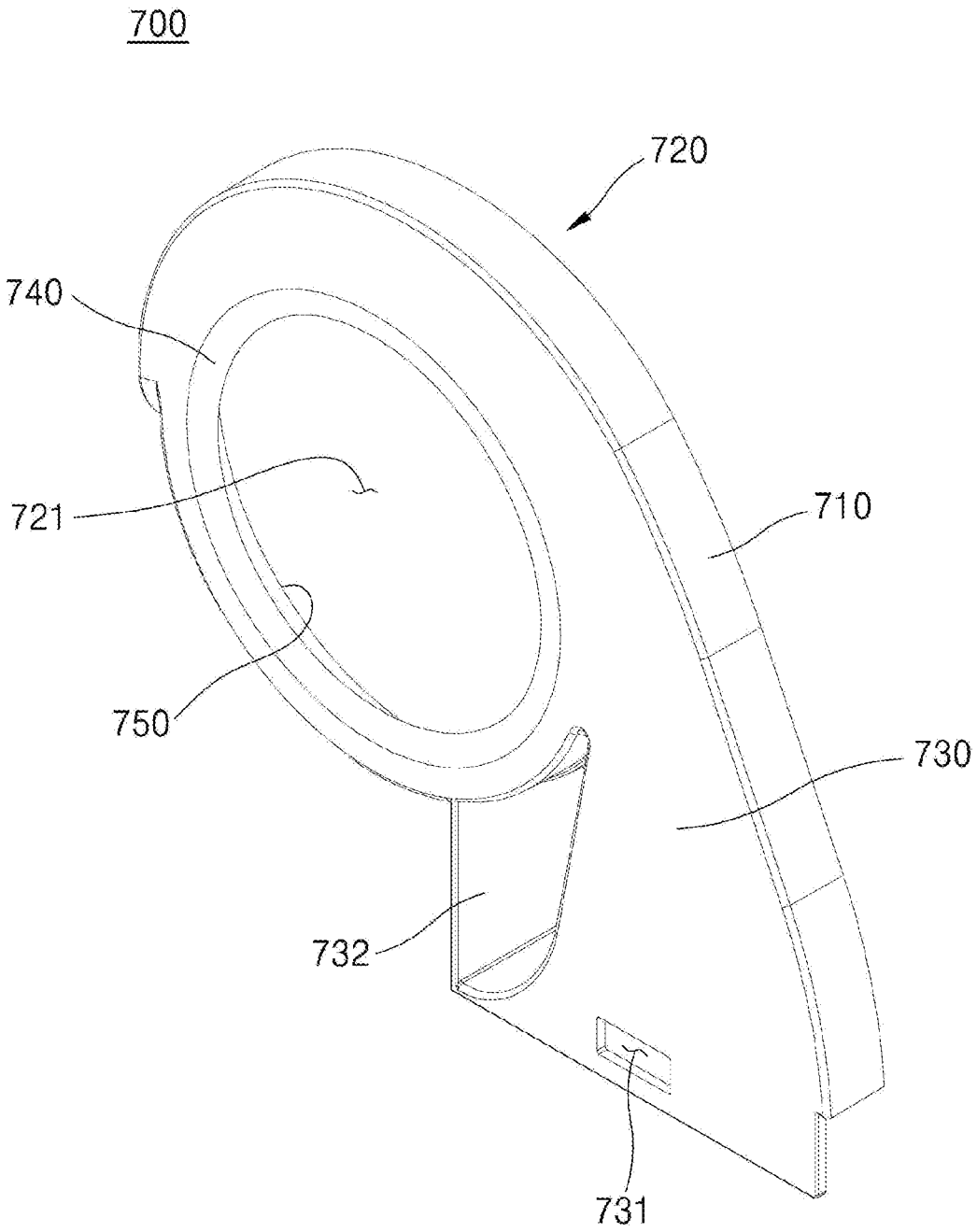
FIG. 14 is a view of FIG. 14, viewed from a different direction.
Figure 15:
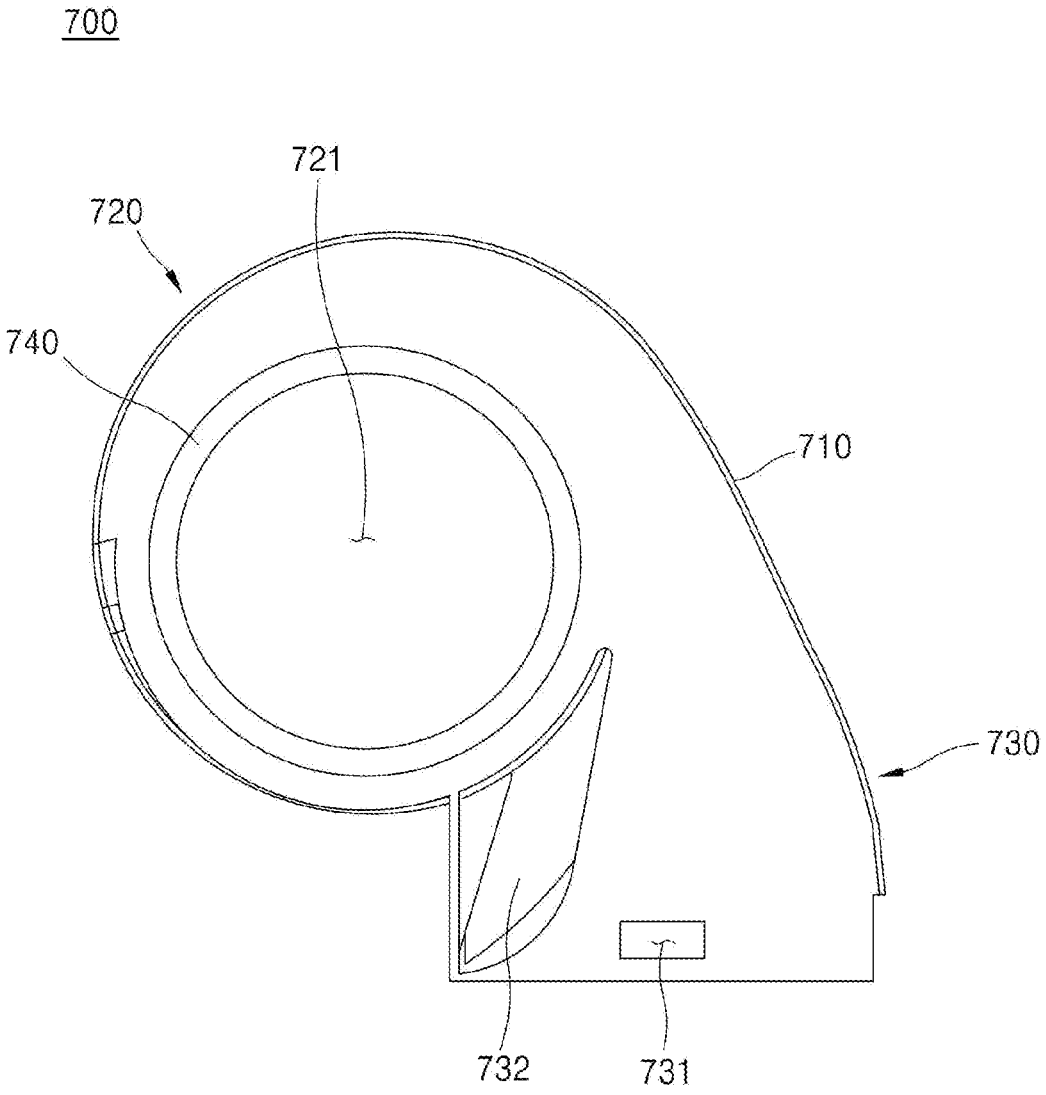
FIG. 15 is a front view showing the air guide.
Figure 16:
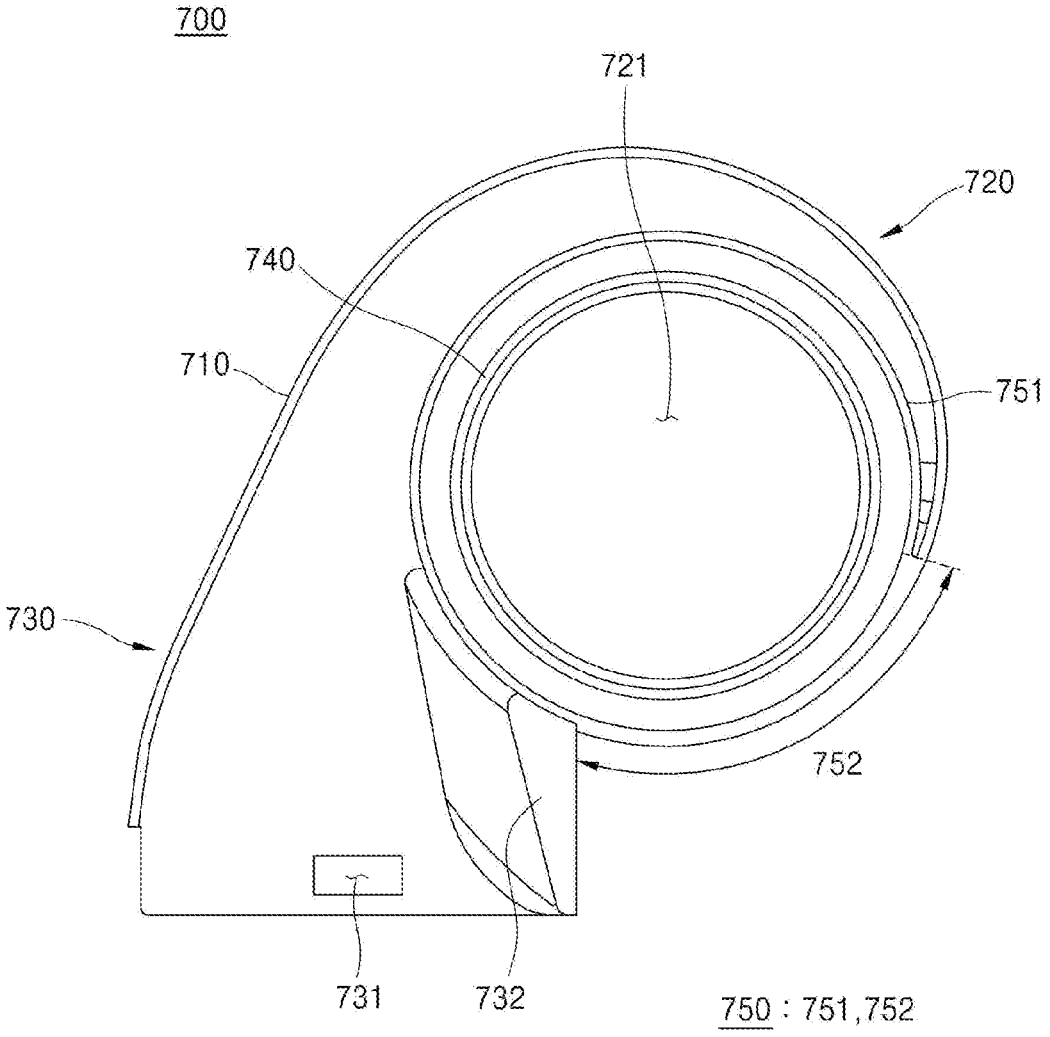
FIG. 16 is a view of FIG. 15, viewed from the opposite direction.

FIG. 13 is a perspective view showing an air guide 700. FIG. 14 is a view of FIG. 14, viewed from a different direction. FIG. 15 is a front view showing an air guide 700. FIG. 16 is a view of FIG. 15, viewed from the opposite direction.

Referring to FIG. 12, the bracket can include a first bushing 101 protruding in a direction of the rotation axis of the impeller 200 to be coupled to the cover 300 and configured to form a space where the impeller 200 is secured.

The air guide 700 can include a second bushing 710 protruding in the rotational direction of the impeller 200, and disposed in an edge area of the air guide 700 and disposed inside the first bushing 101.

The first bushing 101 and the second bushing 710 can partially overlap. The first bushing 101 can also partially overlap with a guide ring which will be described below.

The first bushing 101 can include a first piece 101*a* and a second piece 101*b*. The first piece 101*a* can be formed in an edge area of the bracket 100. The second piece 101*b* can be formed in an arc shape inside the first piece 101*a*.

At least predetermined area of the first piece 101*a* can be disposed to overlap with the second bushing 710. At least predetermined area of the second piece 101*b* can be disposed to overlap with a guide ring 750 formed in the air guide 700.

Since the first bushing 101 of the bracket 100 is disposed to overlap with the second bushing 710 and the guide ring 750 of the air guide, the area through which air is introduced into the impeller 200 from the inside of the drying device 10 can be effectively sealed. Accordingly, the flow path of the air flowing inside the drying device 10 can be kept airtight enough to enhance operating efficiency of the drying device 10.

The air guide 700 can include a second through-hole 721 formed at a position corresponding to the first through-hole 141 and disposed to communicate with the cover 300. In this instance, the mixed air can be introduced into the impeller 200 after passing through the second through-hole 721 from the space formed in the cover 300.

The air guide 700 can include a body 720 and an extending portion 730. The second through-hole 721 can be formed in the body 720. The second through-hole 721 can be formed in an approximately circular shape to be equal to the shape of the impeller 200.

The extending portion 730 can extend from the body 720 and some are of the extending portion 730 can be placed inside the duct 600. The extending portion 730 can have a structure formed to be coupled to the duct 600.

Referring to FIG. 11, the duct 600 can include a pair of protrusions 630 protruding from both sides of an inner surface of the duct 600 at opposite positions, respectively, so that the extending portion 730 can be coupled to the pair of the coupling protrusions 630. One of the two coupling protrusions can be coupled to the air guide 700 and the cover, and the other one can be coupled to the bracket 100.

The extending portion 730 can include a first inserting hole 731 formed at a position corresponding to one of the coupling protrusions 630 and the coupling protrusion 630 is inserted in the first inserting hole 731. Since the coupling protrusion 630 is inserted in the first inserting hole 731, the air guide 700 can be stably coupled to the duct 600 not to escape from the duct 600.

The bracket 100 can include a second inserting hole 102 formed at a position corresponding the other one of the coupling protrusions 630 to insertedly receive the other coupling protrusion 630. Since the coupling protrusion 630 is inserted in the second inserting hole 102, the bracket 100 can be stably coupled to the duct 600 not to escape from the duct 600.

The cover 300 can include a third inserting hole 301 formed at a position corresponding to the first inserting hole 731 of the air guide 700 and the coupling protrusion 630 of the duct 600. One of the coupling protrusions 630 can be coupled to the first inserting hole 731 and the third inserting hole 301. Since the coupling protrusion 630 is inserted in the third inserting hole 301, the cover can be stably coupled to the duct 600 not to escape from the duct 600.

The extending portion 730 can include a sealing protrusion 732 protruding toward the bracket 100 and the cover 300 and configured to suppress the mixed air from flowing out from a contact area of the bracket 100, the cover 300 and the duct 600 by getting contact with them The sealing protrusion 732 can configured to seal a gap that may be formed between the bracket 100, the cover 300 and the duct 600 to suppress the mixed air from leaking through the gap to become a condensate accumulating on the floor of the dishwasher or flowing around the dishwasher.

The sealing protrusion 732 can be formed in a three-dimensional shape having a protruding portion and a recessed portion. When the bracket 100 or the cover 300 has a structure having the same sealing effect as the sealing protrusion 732, the shape of the bracket and the cover can become complicated.

The bracket 100 and the cover 300 can be fabricated by injection-molding. The bracket 100 and the cover 300 can have a complicated structure, compared to the air guide 700. Accordingly, if a structure same as the sealing protrusion 732 is formed in the bracket 100 or the cover 300, there might occur under cut which is a difficult area to take out the bracket 100 and the cover 300 from a mold after they are injected after injection molding due to the 3d structure such as the sealing protrusion 732.

Since the sealing protrusion 732 is formed in the air guide 700 having a relatively simple structure, a structure capable of avoiding the undercut that might occur in the bracket 100 or the cover 300, in other words, a cut off structure can be formed in the dishwasher.

Accordingly, In some implementations, the sealing protrusion 732 having the 3d and relatively complicated shape can be formed not in the bracket 100 or the cover 300 but in the air guide 700 having a relatively simple shape.

Since structure same as the sealing protrusion 732 is formed in the bracket 100 or the cover 300, the occurrence of the undercut can be suppressed. Accordingly, the manufacturing time and the manufacturing cost can be reduced in manufacturing the drying device by injection molding.

Figure 17:
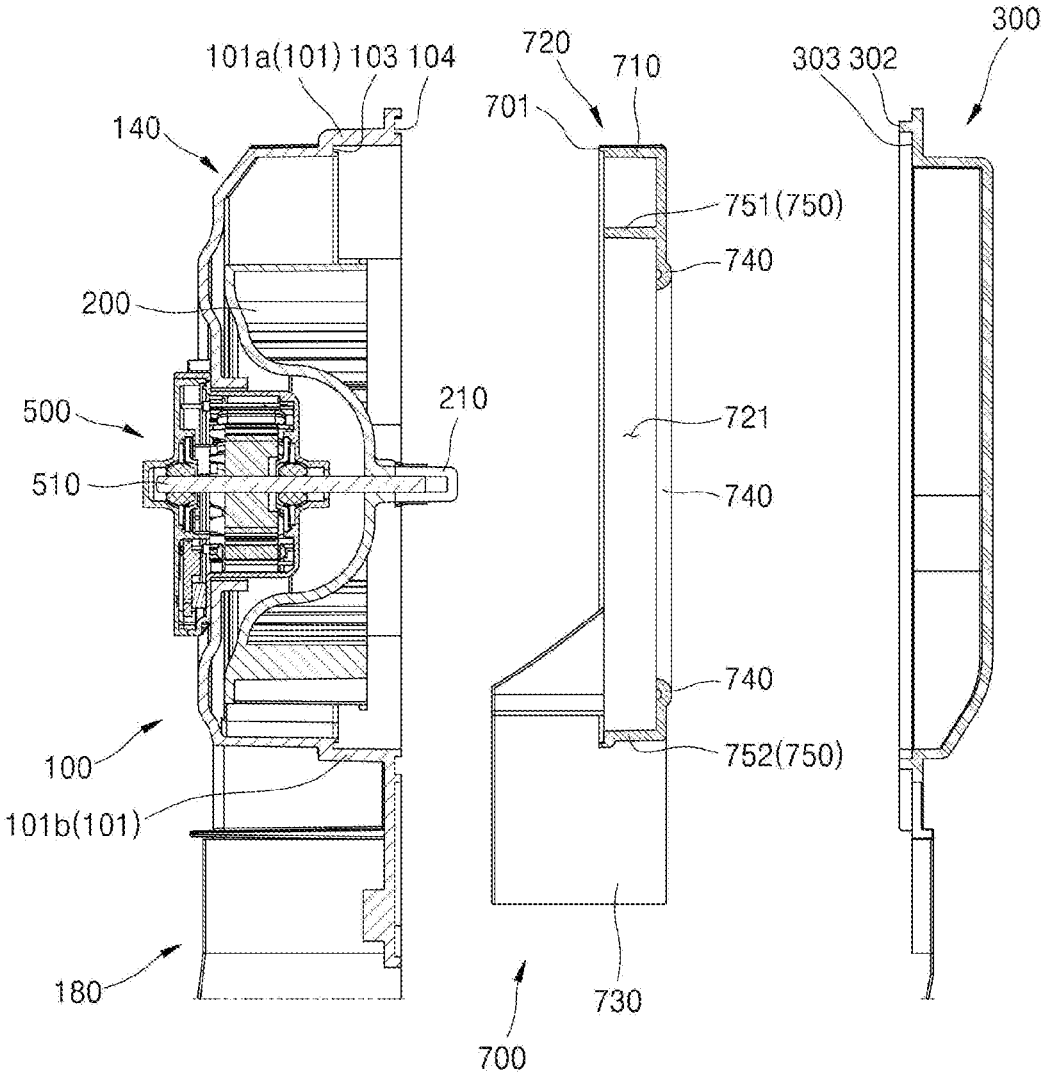
FIG. 17 is an exploded sectional view showing the bracket, the cover, and the air guide.
Figure 18:
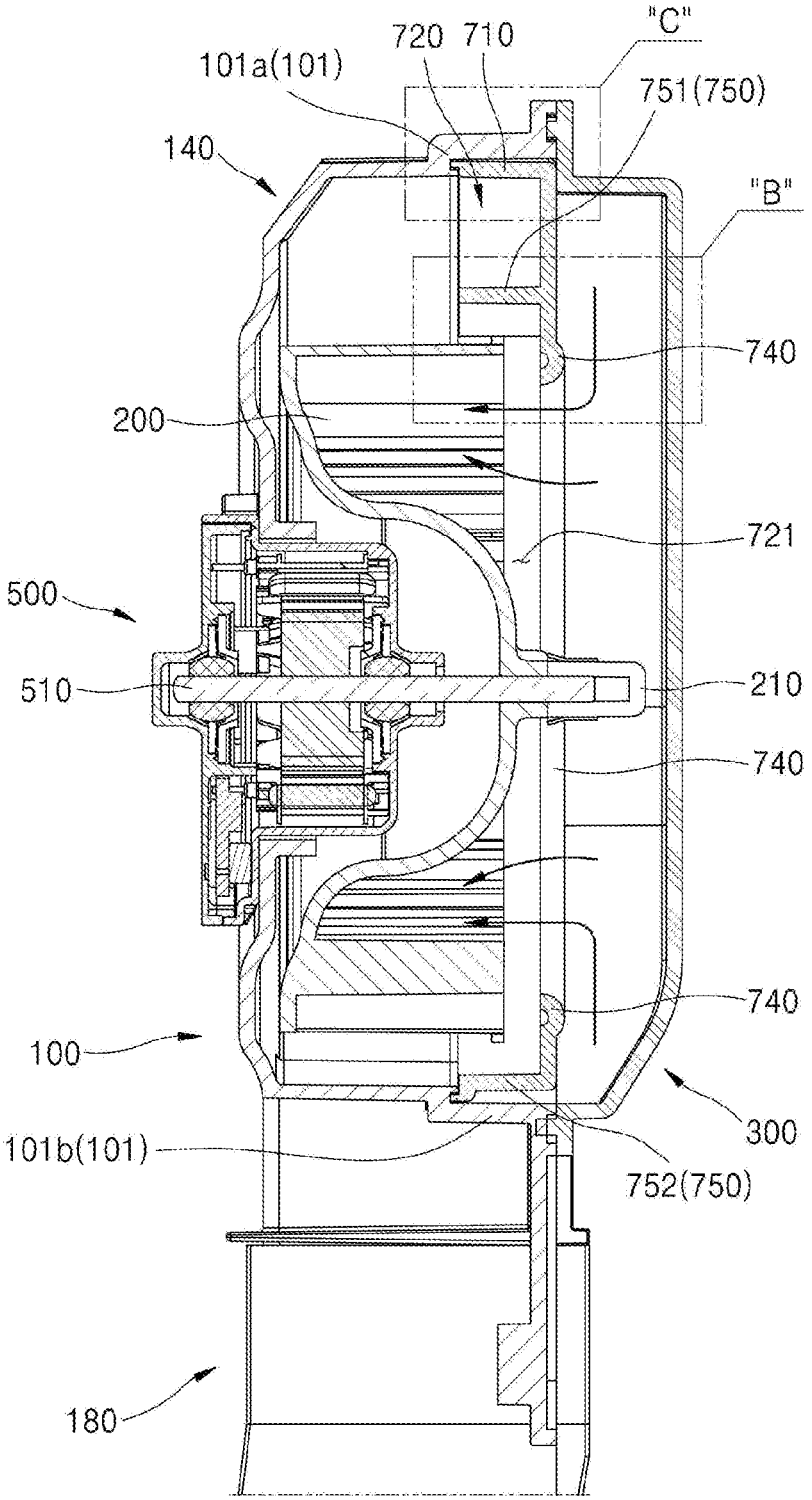
FIG. 18 is a sectional view showing an assembled state of FIG. 17.

FIG. 17 is an exploded sectional view showing a bracket 100, a cover 300 and an air guide 700. FIG. 18 is a sectional view showing an assembled state of FIG. 17.

In FIG. 18, a flow path of the mixed air can be shown with arrows. The mixed air can flow into the impeller 200 from a space where the cover 300 is formed through the second through-hole 721. Then, the mixed air can be mixed more uniformly while passing through the impeller 200.

The air guide 700 can include a bell mouth 740 formed along a circumference of the second through-hole 721, with a convex shape toward the cover 300, and configured to guide the flow of the mixed air into the impeller 200 from the flow space of the cover 300.

As shown in arrow of FIG. 18, the mixed air can be introduced into the impeller 200 from the space where the cover 300 is formed. The mixed air in an area adjacent to the edge of the second through-hole 721 can be changed rapidly so that the flow direction of the mixed air is close to 90 degrees.

The bell mouth 740 can be formed in an edge of the second through-hole 721 so that the edge of the second through-hole 721 can be curved toward the cover 300. Accordingly, the mixed air passing through the cover 300 near the edge of the second through-hole 271 can stably pass through the second through-hole 721, without forming a vortex at the edge of the second through-hole 721.

In some implementations, the bell mouth 740 can be formed at the edge of the second through-hole 721 provided in the air guide 700, so that the flow of the mixed air drawn into the second through-hole 721 of the air guide 700 can be facilitated enough to enhance the operating efficiency of the drying device 10.

The air guide 700 can include a guide ring 750 protruding from the body 720 toward the bracket 100 and configured to surround the bell mouth 740.

The guide ring 750 can surround the bell mouth 740 and protrude toward the bracket 100, to guide the mixed air having passed through the second through-hole 721 to smoothly flow straight toward the impeller 200.

The guide ring 750 can include a first region 751 and the second region 752. The first region 751 can be disposed inside the second bushing 710. The second region 752 can be disposed at a portion of the edge of the air guide 700, where the second bushing 710 is not formed.

The second region 752 and the first bushing 101 can overlap. Referring to FIG. 18, the second region 752 of the guide ring 750 can overlap with the second piece 101*b* of the first bushing 101 of the bracket 100. The second bushing 710 of the air guide 700 can overlap with the first piece 101*a* of the first bushing 101 of the bracket 100.

Due to this structure, the gap which may be formed between the air guide 700 and the bracket 100 can be effectively sealed. Accordingly, the leakage of the mixed air through the gap between the air guide 700 and the bracket 100 can be effectively blocked.

Figure 19:
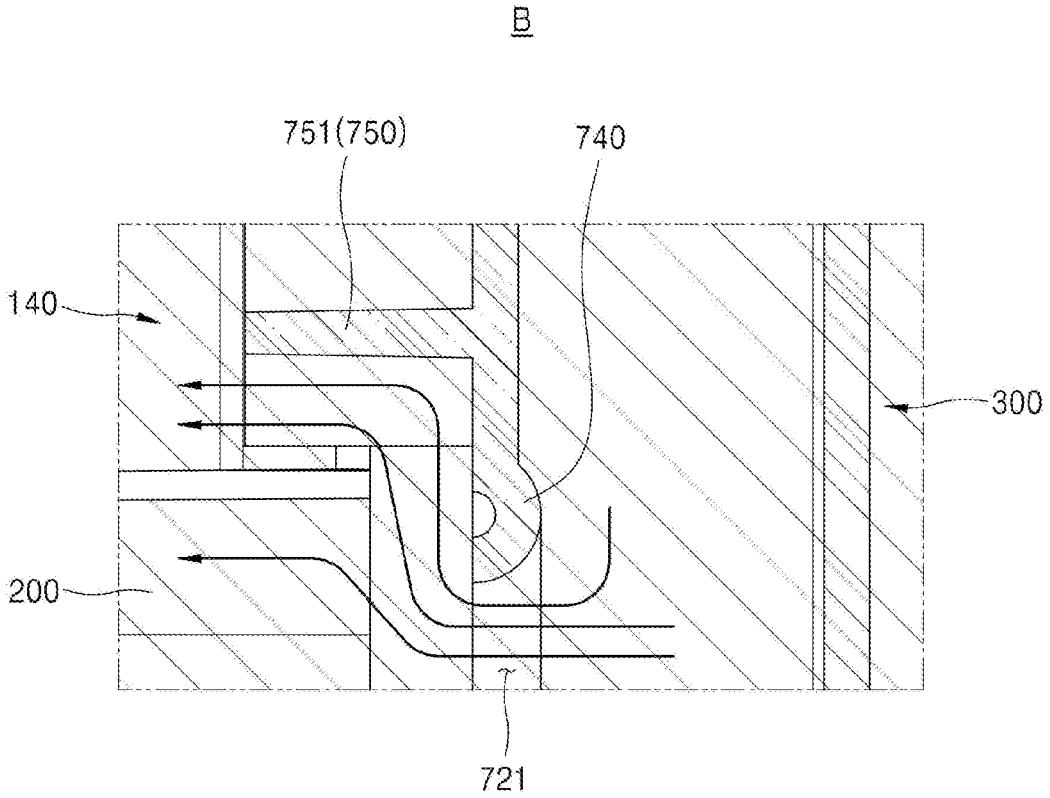
FIG. 19 is an enlarged view showing 'B' of FIG. 18.
Figure 20:
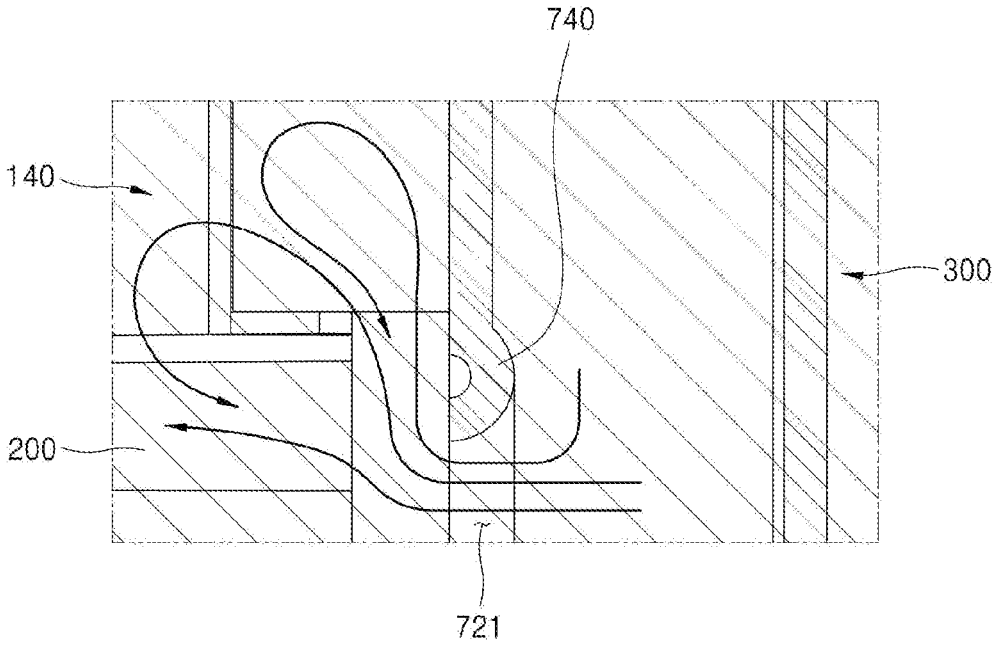
FIG. 20 is a view of a comparative example shown to be compared to FIG. 19.

FIG. 19 is an enlarged view showing 'B' of FIG. 18. FIG. 20 is a view of a comparative example shown to be compared to FIG. 19.

The guide ring 750 can be provided to suppress the mixed air introduced into the impeller 200 after passing through the second through-hole 721 from causing circulating air flow in bell mouth 740.

As shown in FIG. 19, the guide ring 750 can be disposed to protrude toward the impeller 200 with respect to the flow direction of the mixed air. In some examples, the guide ring 750 can be disposed to surround the bell mouth 740.

Due to this structure, the flow direction of the mixed air passing through the second through-hole 721 can be changed adjacent to the bell mouth 740 to flow in a radial direction of the impeller 200, and can be blocked by the guide ring to change the flow direction again in a direction perpendicular to the radial direction of the impeller 200, so that the air can be introduced into the impeller 200.

In this state, the circulating flow of the mixed air may not occur at the edge area of the impeller 200, but the mixed air can be smoothly introduced into the impeller 200 while the rotation of the impeller 200 is not prevented by the circulating air flow. Accordingly, the power consumption of the impeller 200 can be reduced and the operating efficiency of the drying device 10 can be improved.

Referring to FIG. 20, unless the guide ring 750 is provided, the mixed air passing through the second through-hole 721 near the bell mouth 740 will change the flow direction to continuously flow in the radial direction of the impeller 200 as getting farther from the edge area of the impeller 200.

When the flowing mixed air continuously gets farther from the edge of the impeller 200, the circulating flow of the mixed air may occur in the space formed in the edge of the bracket 100 as shown in FIG. 20.

The inflow of the mixed air into the impeller 200 can be hindered by the circulating flow of the mixed air and the rotation of the impeller 200 can be hindered by the circulating air flow: Accordingly, electricity consumption of the impeller 200 might increase and the operating efficiency of the drying device 10 might decrease.

In some implementations, the guide ring 750 can be configured to guide the flow direction of the mixed air introduced through the second through-hole 721 and effectively suppress the circulating flow of the mixed air at the position adjacent to the bell mouth 740.

Accordingly, the mixed air can be smoothly introduced into the impeller 200 and the rotation of the impeller 200 may not be interfered with by the circulating flow. Accordingly, the power consumption of the impeller 200 can be reduced and the operating efficiency of the drying device 10 can be improved.

Figure 21:
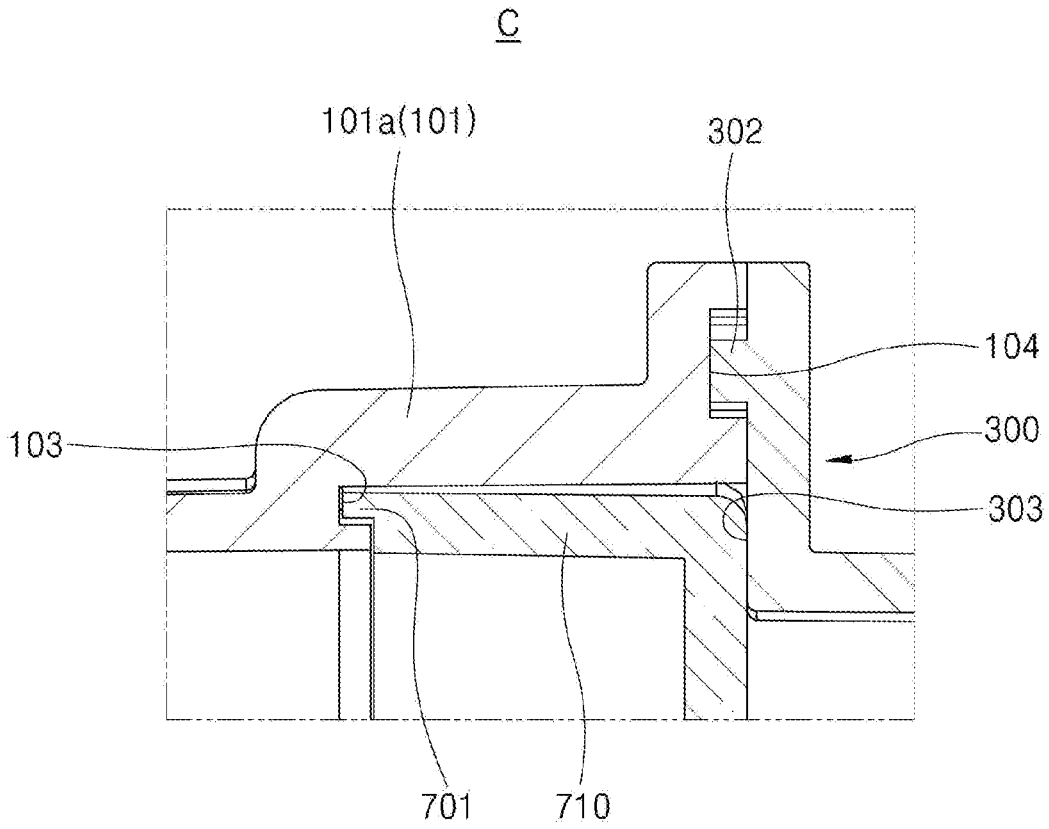
FIG. 21 is an enlarged view showing 'C' of FIG. 18.

FIG. 21 is an enlarged view showing 'C' of FIG. 18. Referring to FIGS. 17 and 21, a first groove 103 can be provided in the bracket 100. The first groove 103 can be recessed from an inner wall of the bracket 100 inside the first piece 101*a* of the first bushing 101.

The air guide 700 can include a first protrusion 701. The first protrusion 701 can protrude from one end of the second bushing 710 of the air guide 700 toward the first groove 103 and disposed at a position corresponding to the first groove 103. The first protrusion 701 can be secured to the first groove 103 so that the air guide 700 can be stably coupled to the bracket 100 even without an auxiliary coupling member.

The bracket 100 can further include a second groove 104. The second groove 104 can be formed in the outside of the first piece 101*a* of the first bushing 101 and recessed from an area extending from the first piece 101*a*. The second groove 104 can be disposed at a position spaced apart from the first groove 103 in the width direction of the bracket 100 in cross-section of the bracket 100.

The cover 300 can include a second protrusion 302. The second protrusion 302 can protrude from an edge of the cover 300 toward the second groove 104, and can be formed at a position corresponding to the second groove 104.

The cover 300 can include a seating portion 303. The seating portion 303 can be formed inside the second groove 104 from the second protrusion 302, and configured to support a lateral surface of the second bushing 710 of the air guide 700 and an end of the first piece 101*a* of the first bushing 101.

Referring to FIG. 21, the second protrusion 302 can be secured to the second groove 104, and a fusion process can be performed on the second groove 104 and the second protrusion 302, so that the bracket 100 and the cover 300 can be fixedly coupled to each other.

When the bracket 100 and the cover 300 are coupled to each other, the second bushing 710 of the air guide 700 can have the first protrusion 701 seated on the first groove 103 of the bracket 100 and the other side stably supported by the seating portion 303 of the cover 300.

Due to this structure, when the bracket 100 and the cover 300 are coupled to each other by the fusion process, the air guide 700 secured between them can be assembled inside the drying device 10 without using an auxiliary coupling member.

The process of securing the air guide 700 to the bracket 100 or mounting the air guide 700 to the cover 300 can be omitted, and the air guide can be coupled to the drying device 10 by performing one process of fusion-bonding the bracket 100 and the cover 300.

In some implementations, the assembling of the bracket 100, the air guide 700 and the cover 300 can be completed by performing one fusion process or coupling process, thereby facilitating smooth assembling of the drying device 10. Accordingly, the manufacturing cost of the drying device 10 can be reduced and the occurrence of detective assembly of the drying device 10 can be effectively suppressed.

Figure 22:
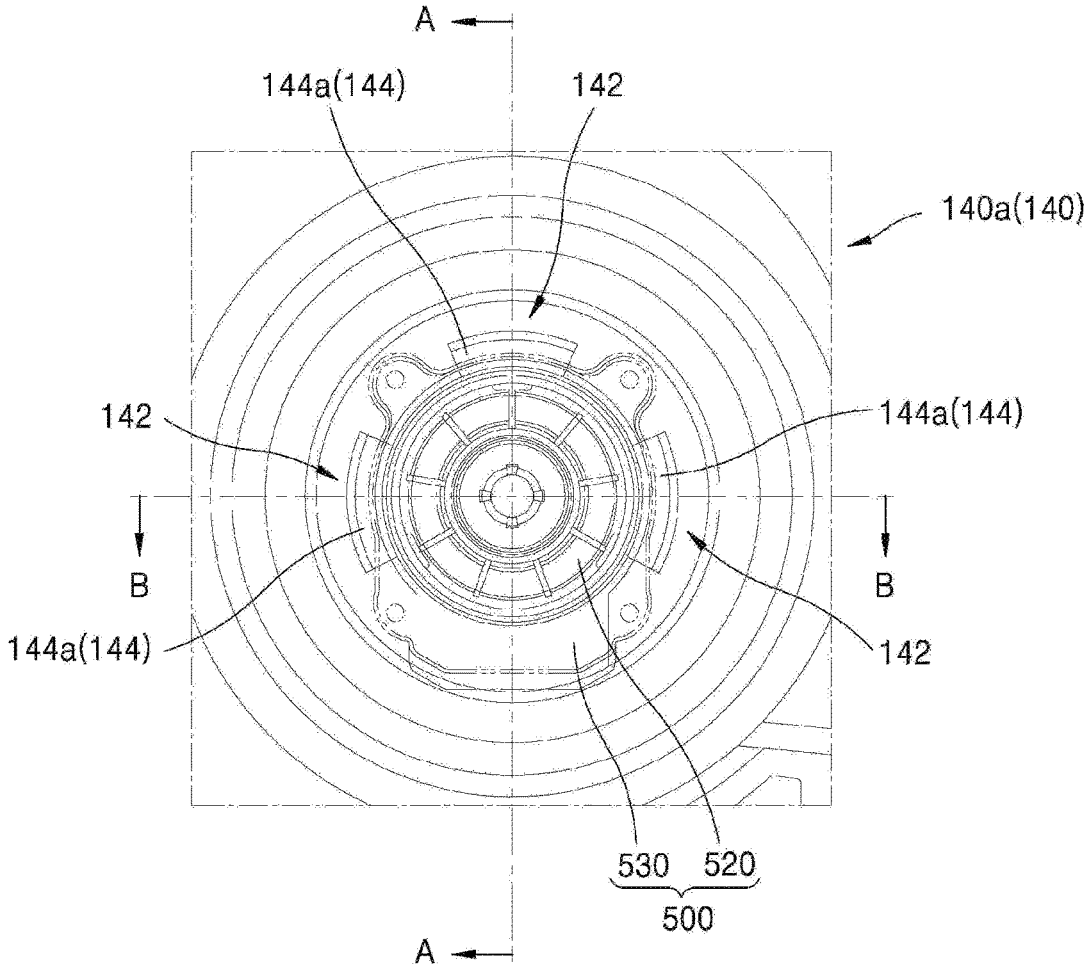
FIG. 22 is an enlarged front view of a casing of the drying device in which a motor is disposed.
Figure 23:
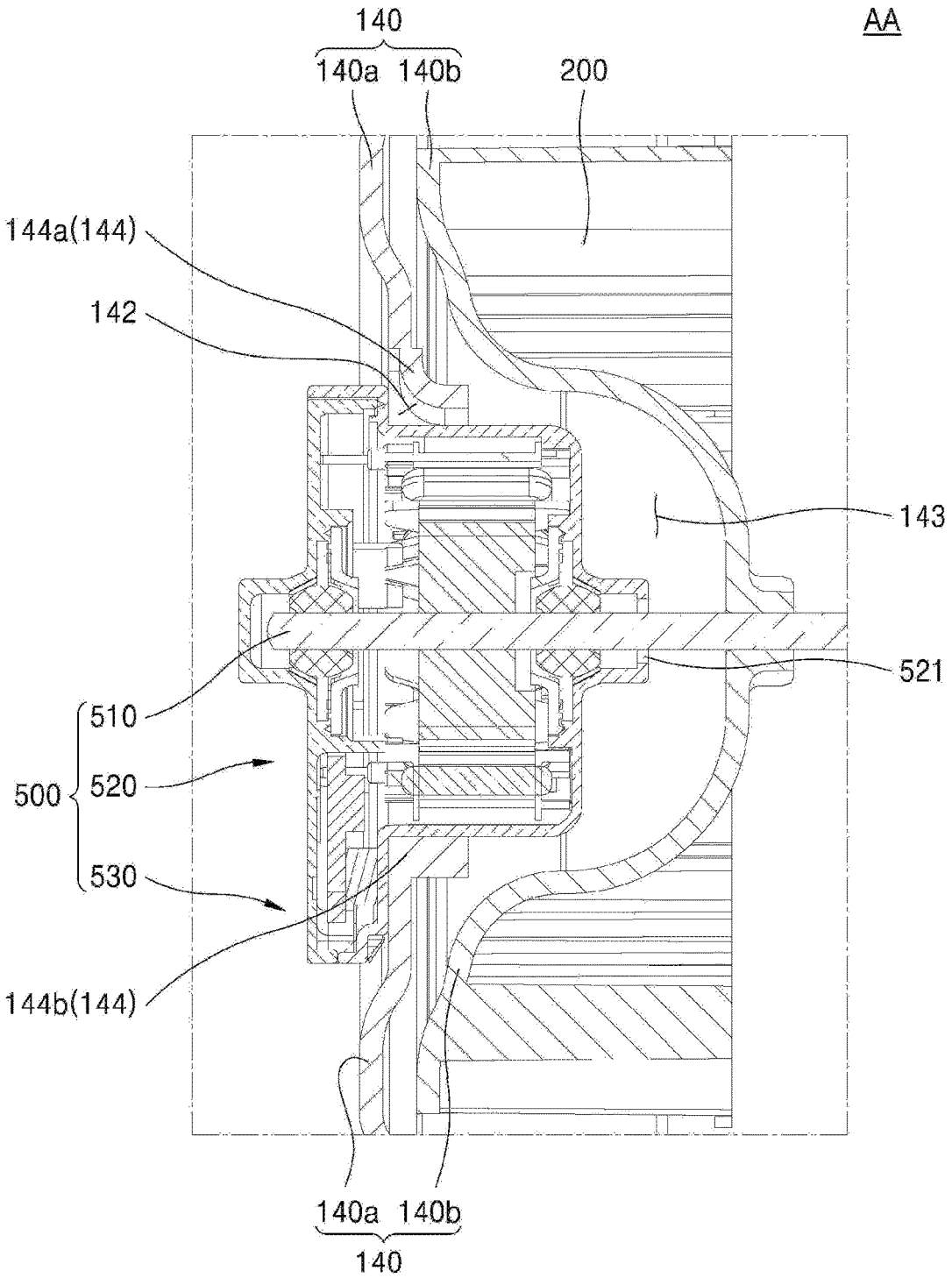
FIG. 23 is a sectional view along 'AA' of FIG. 22.

FIG. 22 is an enlarged front view of a casing 140 of a drying device 10 in which a motor 500 is disposed. FIG. 23 is a sectional view along 'AA' of FIG. 22. The motor 500 can be mounted to the casing 140. The motor 500 can be disposed in the casing 140 and configured to rotate the impeller 200.

The motor can include a driving part 520 and a motor mounting part 530. A second shaft 510 can be coupled to the driving part 520. The driving part 520 can be supplied electricity from an external power supply to operate and configured to rotate the second shaft 510. The motor mounting part 530 can mount the driving part 520 to the casing 140.

A groove can be formed in the casing 140 and the driving part 520 can be inserted in the groove. In a state where some area of the driving part 520 is inserted in the groove, the motor mounting part 530 coupled to the driving part 520 can be coupled to the casing 140 to mount the motor 500 to the casing 140.

To be coupled to the second shaft 510 and to protrude the second shaft 510 to the outside of the driving part 520, the driving part 520 can have a through-hole 521 through which the second shaft 510 passes. When the impeller 200 is rotated, wet air flowing in from the tub 2 can flow inside the drying device 10 and some of the wet air can flow outside of the driving part 520.

The wet air flowing outside the driving part 520 may be introduced into the driving part 520 through the through-hole 521. The wet air introduced into the driving part 520 might corrode a coil and other components for the operation of the motor 500. The wet air may be restricted from flowing into the driving part 520 through the through-hole 521.

For example, to suppress the wet air from flowing into the driving part 520 of the motor 500, a slit hole 142 can be formed in the casing 140. The slit hole 142 can surround the motor 500 to lead dry air into the casing 140 from the outside. The casing 140 can include an outer panel 140*a* and an inner panel 140*b*. The motor 500 can be mounted to the outer panel 140*a*.

The inner panel 140*b* can be spaced apart from the outer panel 140*a*. The inner panel 140*b* can be coupled to an end of the second shaft 510 and configured to rotate as the second shaft 510 is rotated. The impeller 200 can be coupled to the inner panel 140*b*. Accordingly, as the second shaft 510 is rotated, the inner panel 140*b* can be rotated together with the impeller 200 so that dry air and wet air can flow inside the drying device 10 by the rotation of the impeller 200.

Since the inner panel 140*b* is spaced apart from the outer panel 140*a*, a flow portion 143 can be formed that is a flow space in which the dry air introduced into the casing 140 can flow.

The slit hole 142 can be formed in the outer panel 140*a* to surround the motor 500. For example, the slit hole 142 can be formed in the outer panel 140*a* to surround at least predetermined area of the motor 500.

The flow portion 143 can be in communication with the outside by the slit hole 142 so that dry air can be introduced into the flow portion 143 from the outside through the slit hole 142.

The slit hole 142 can be provided in plural and each slit hole 142 can be provided in an arc shape surrounding the motor 500. In some implementations, as shown in FIG. 22, three slit holes 142 can be provided. In some implementations, two or four or more slit holes can be provided. The number of the slit holes 142 can be appropriately selected based on the size of the driving part 520, the shape of the motor mounting part 530 and the size of the casing 140.

Each slit hole 142 can be provided so as to surround the circumference of the driving part 520 having a circular cross-section, an appropriate width, and an arc shape in a longitudinal direction.

Figure 24:
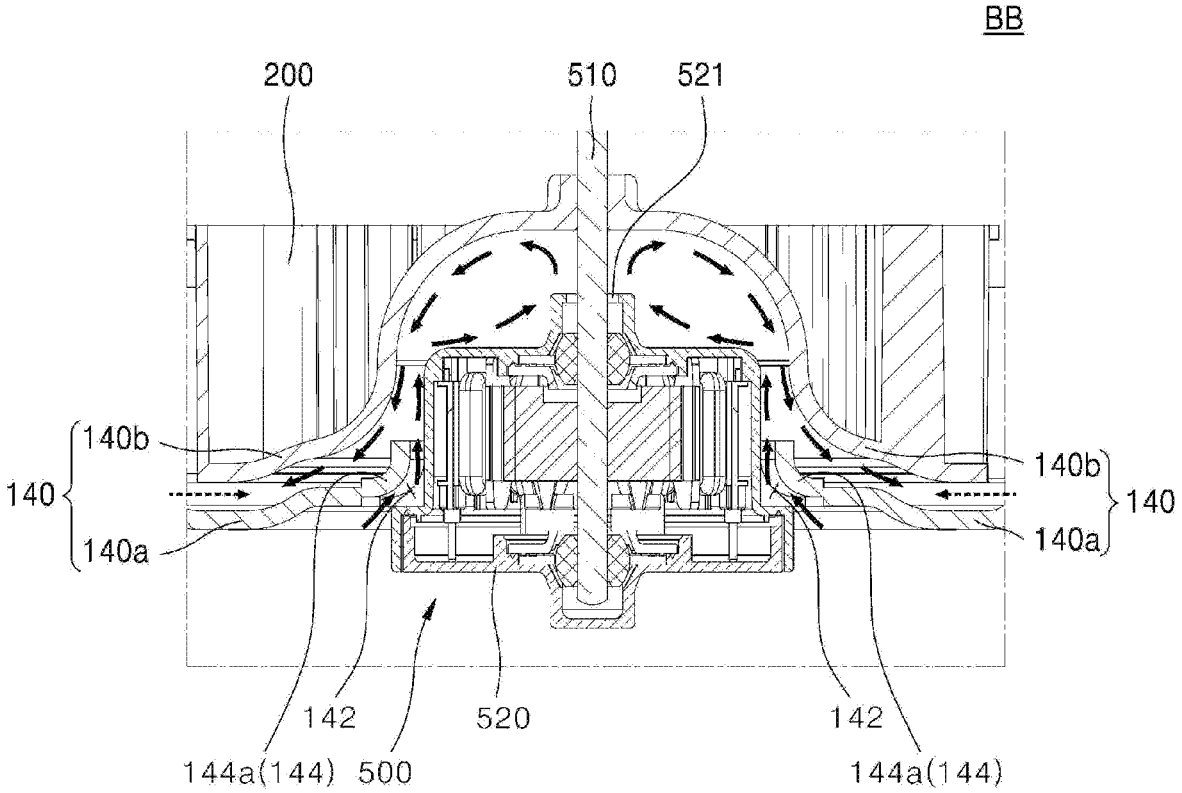
FIG. 24 is a sectional view along 'BB' of FIG. 22.

FIG. 24 is a sectional view along BB' of FIG. 22. In FIG. 24, the flow of dry air is shown by a solid arrow and the flow of wet air is shown by a hidden line.

Referring to FIGS. 22 to 24, the driving part 520 can be coupled to the outer panel 140*a*. The outer panel 140*a* can include a bent portion 144 forming a groove to which the driving part 520 is secured. In this instance, the slit hole 142 can be spaced apart from the bent portion 144 in a radial direction of the driving part 520.

The bent portion 144 can define a shape of a groove to which the driving part 520 is secured. The bent portion 144 can include a first bent portion 144*a* spaced apart from the driving part 520 and a second bent portion 144*b* in contact with the driving part 520.

The slit hole 142 can be formed between the outer panel 140*a* and the driving part 520. Without the slit hole 142, the bent portion 144 can include only the second bent portion 144*b*. For example, the outer panel 140*a* and the driving part 520 can be in contact with each other so that the groove of the casing 140 can be sealed by the driving part 520. In other words, the driving part 520 can be in contact with an inner surface of the second bent portion 144*b* of the outer panel 140*a*, so as to seal the groove of the casing 140.

However, In some implementations, the first bent portion 144*a* can be formed in an area where the slit hole 142 is formed. The first bent portion 144*a* can be formed by recessing the groove, to which the driving part 520 is secured, deeper than the second bent portion 144*b*.

A lateral surface of the first bent portion 144*a* that forms the slit hole 142 can be disposed further outward from the center of the driving part 520 than a lateral surface of the second bent portion 144*b*. accordingly, the first bent portion 144*a* can be spaced a preset distance apart from an outer circumferential surface of the driving part 520 in a radial direction of the driving part 520, and the distance, that is, gap can be the slit hole 142 that serves as a passage of the outside air from the outer panel 140*a*.

In other words, the slit hole 142 can be formed by opening some area of the outer panel 140*a* by the first bent portion 144*a* outward in the radial direction from the center of the driving part 520 along the circumferential surface of the second bent portion 144*b* where the outer panel 140*a* and the driving part 520 are in contact.

Specifically, considering a diameter of the groove of the outer panel 140*a* in which the driving part 520 is disposed, the diameter of the groove in the first bent portion 144*a* in which the slit hole 142 is formed can be larger than the diameter of the groove in the second bent portion 144*b*. Accordingly, the first bent portion 144*a* and the groove may not be in contact with each other and a gap can be formed to be the slit hole 142.

When the impeller 200 is rotated by the operation of the drying device 10, wet air inside the tub 2 can flow into the drying device 10 and flow inside the drying device 10. The wet air can approach the motor 500 provided in the drying device 10.

For example, as shown in FIG. 24, the wet air may approach the driving part 520 of the motor 500 through a gap between the outer panel 140*a* and the inner panel 140*b*. Thus, the wet air might flow into the driving part 520 through the gap between the through-hole 521, in which the second shaft 510 is inserted, and the second shaft 510, only to corrode the component provided inside the driving part 520.

To suppress the wet air from flowing into the driving part 520, the slit hole 142 can be formed in the outer panel 140*a* of the casing 140. Dry air can be introduced into the flow portion 143 from the outside of the drying device 10 through the slit hole 142, and the dry air can suppress the flow of the wet air.

When the impeller 200 is rotated, a lower pressure than the outside, that is, a negative pressure can be formed in the inside of the bracket 100 as a whole. Accordingly, outside dry air can be introduced into the bracket 100 through the first inlet 110. Similarly, when the impeller 200 is rotated, a negative pressure can be formed in the flow portion 143 formed inside the casing 140.

Accordingly, when the impeller 200 is rotated, outside dry air can be introduced into the flow portion 143 through the slit hole 142 and flow inside the flow portion 143. The dry air flowing inside the flow portion 143 can surround the through-hole 521 and the wet air flowing inside the drying device 10 can be effectively suppressed from approaching the through-hole 521. Accordingly, the inflow of the wet air into the driving part 520 through the gap formed in the through-hole 521 can be effectively suppressed.

In some implementations, the slit hole 142 can be formed in the casing 140. When the impeller 200 is rotated by the operation of the motor 500, outside dry air can be introduced in to the flow portion 143 formed in the casing 140 through the slit hole 142 so that the flow of the wet air into the flow portion 143 can be suppressed. Accordingly, the wet air can be effectively suppressed from flowing into the driving part 520 through the flow portion 143 and corroding the components provided in the driving part 520.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

What is claimed is:

1. A dishwasher comprising:

a tub that defines a washing space configured to accommodate objects to be washed;

a door coupled to a front of the tub and configured to open and close the tub; and a drying device disposed at the door and configured to dry an inside of the tub, the drying device being configured to guide (i) wet air discharged from the inside of the tub and (ii) dry air introduced from an outside of the tub, wherein the drying device comprises:

a bracket that defines a space configured to receive the wet air and the dry air, an impeller coupled to the bracket and configured to cause the wet air and the dry air to be mixed, the impeller being configured to generate a flow of the mixed air, a cover coupled to the bracket, and an air guide disposed between the bracket and the cover and configured to guide the flow of the mixed air into the impeller, wherein the impeller is rotatably coupled to the air guide, wherein the bracket comprises a first bushing that is coupled to the cover and protrudes in a direction of a rotational axis of the impeller, and wherein the air guide comprises a second bushing that protrudes in the direction of the rotation axis of the impeller and defines an edge area of the air guide.

2. The dishwasher of claim 1, wherein the first bushing defines a space that accommodates at least a portion of the impeller, and wherein the second bushing is disposed inside the first bushing such that the first bushing and the second bushing overlap with each other.

3. The dishwasher of claim 2, wherein the bracket further comprises a casing that defines a mounting space of the impeller, the mounting space including a first through-hole that is open in the direction of the rotation axis of the impeller.

4. The dishwasher of claim 3, wherein the drying device further comprises a motor disposed in the casing and configured to rotate the impeller, and wherein the casing defines a slit hole that surrounds at least a portion of the motor and is configured to receive the dry air into the casing.

5. The dishwasher of claim 4, wherein the casing comprises:

an outer panel that defines the slit hole; and an inner panel that is spaced apart from the outer panel and defines a flow portion together with the outer panel, the flow portion being configured to carry the dry air introduced into the casing, and wherein the motor is mounted to the outer panel, and the slit hole extends along at least the portion of the motor.

6. The dishwasher of claim 5, wherein the motor comprises:

a driving part coupled to the outer panel; and a bent portion that is coupled to the driving part and defines a groove accommodating the driving part, and wherein the slit hole is spaced apart from the bent portion in a radial direction of the driving part.

7. The dishwasher of claim 3, wherein the air guide defines a second through-hole at a position corresponding to the first through-hole, the second through-hole being in fluid communication with the cover.

8. The dishwasher of claim 7, wherein the drying device further comprises a duct that is in fluid communication with the bracket and an outlet of the cover, the duct being configured to discharge the mixed air from the impeller to the outside.

9. The dishwasher of claim 8, wherein the bracket defines:

a first inlet that is in fluid communication with the outside of the tub and configured to receive the dry air from the outside; and a second inlet that is spaced apart from the first inlet and in fluid communication with the tub, the second inlet being configured to receive the wet air from the tub.

10. The dishwasher of claim 9, wherein the drying device further comprises a valve coupled to the bracket and disposed in a flow path of the wet air, the valve being configured to open and close the second inlet.

11. The dishwasher of claim 9, wherein the bracket comprises:

a first communication portion that defines a space in fluid communication with the cover;

a partition wall that defines the second inlet and partitions off the first communication portion from an inner space of the bracket; and a first outlet that is in fluid communication with the duct and configured to discharge the mixed air having passed through the impeller.

12. The dishwasher of claim 11, wherein the cover comprises:

a second communication portion that is coupled to the first communication portion and defines a space in fluid communication with the bracket; and a third inlet that enables fluid communication between the second communication portion and the tub, the third inlet being configured to supply the wet air from the tub into the drying device.

13. The dishwasher of claim 8, wherein the air guide comprises:

a body that defines the second through-hole; and an extending portion that extends from the body and is disposed inside the duct.

14. The dishwasher of claim 13, wherein the duct comprises a pair of coupling protrusions that protrude from an inner surface of the duct and face each other, the pair of coupling protrusions being coupled to the extending portion, and wherein the extending portion defines a first inserting hole at a position corresponding to a first coupling protrusion of the pair of coupling protrusions, the first inserting hole receiving the first coupling protrusion.

15. The dishwasher of claim 14, wherein the bracket defines a second inserting hole at a position corresponding to a second coupling protrusion of the pair of coupling protrusions, the second inserting hole receiving the second coupling protrusion.

16. The dishwasher of claim 13, wherein the extending portion comprises a sealing protrusion that protrudes toward the bracket and the cover, the sealing protrusion being in contact with the bracket, the cover, and the duct to thereby block the mixed air from leaking through a gap defined among the bracket, the cover, and the duct.

17. The dishwasher of claim 13, wherein the air guide comprises a bell mouth that extends along a circumference of the second through-hole and has a convex shape protruding toward the cover, the bell mouth being configured to guide the flow of the mixed air from the cover to the impeller.

18. The dishwasher of claim 17, wherein the air guide further comprises a guide ring that protrudes from the body toward the bracket and surrounds the bell mouth.

19. The dishwasher of claim 18, wherein the guide ring comprises:

a first region disposed inside the second bushing; and a second region disposed at a portion of the edge area of the air guide in which the second bushing is not provided, and wherein the second region and the first bushing overlap with each other.

20. The dishwasher of claim 18, wherein the guide ring is configured to reduce a circulation flow of the mixed air along the bell mouth based on the mixed air being introduced into the impeller through the second through-hole.

* * * * *